US011308765B2

(12) United States Patent
Lockton et al.

(10) Patent No.: US 11,308,765 B2
(45) Date of Patent: Apr. 19, 2022

(54) METHOD AND SYSTEMS FOR REDUCING RISK IN SETTING ODDS FOR SINGLE FIXED IN-PLAY PROPOSITIONS UTILIZING REAL TIME INPUT

(71) Applicant: Winview, Inc., Redwood City, CA (US)

(72) Inventors: David B. Lockton, Redwood City, CA (US); Kathy A. Lockton, Redwood City, CA (US)

(73) Assignee: Winview, Inc., Redwood City, CA (US)

( * ) Notice: Subject to any disclaimer, the term of this patent is extended or adjusted under 35 U.S.C. 154(b) by 0 days.

(21) Appl. No.: 16/276,292

(22) Filed: Feb. 14, 2019

(65) Prior Publication Data

US 2020/0111325 A1 Apr. 9, 2020

Related U.S. Application Data

(60) Provisional application No. 62/742,593, filed on Oct. 8, 2018.

(51) Int. Cl.
*G07F 17/32* (2006.01)

(52) U.S. Cl.
CPC ..... *G07F 17/3288* (2013.01); *G07F 17/323* (2013.01); *G07F 17/3209* (2013.01); *G07F 17/3211* (2013.01)

(58) Field of Classification Search
CPC ..... G07F 17/3239; G07F 17/3276; G07F 17/323; G07F 17/3244; G07F 17/3288; A63F 13/798
See application file for complete search history.

(56) References Cited

U.S. PATENT DOCUMENTS

| | | | |
|---|---|---|---|
| 2,831,105 | A | 4/1958 | Parker |
| 3,562,650 | A | 2/1971 | Gossard et al. |
| 4,141,548 | A | 2/1979 | Everton |
| 4,270,755 | A | 6/1981 | Willhide et al. |
| 4,386,377 | A | 5/1983 | Hunter, Jr. |
| 4,496,148 | A | 1/1985 | Morstain et al. |
| 4,521,803 | A | 6/1985 | Gittinger |

(Continued)

FOREIGN PATENT DOCUMENTS

| | | |
|---|---|---|
| CA | 2252074 | 11/1997 |
| CA | 2252021 | 11/1998 |

(Continued)

OTHER PUBLICATIONS

Two Way TV Patent and Filing Map www.twowaytv.com/version4/technologies/tech_patents.asp.

(Continued)

*Primary Examiner* — William H McCulloch, Jr.
(74) *Attorney, Agent, or Firm* — Haverstock & Owens, A Law Corporation

(57) ABSTRACT

A skill game operator provides real time propositions to a viewing audience, and based on the input received from those propositions, comparable In-Play wagering propositions are able to be generated, and the odds of the In-Play propositions are able to be accurately adjusted based on the actual input received from the same participating audience the skill game operator's responses to the same propositions.

44 Claims, 4 Drawing Sheets

(56) References Cited

U.S. PATENT DOCUMENTS 4,592,546 A * 6/1986 Fascenda ..... A63F 3/064 463/29
4,816,904 A 3/1989 McKenna et al.
4,918,603 A 4/1990 Hughes et al.
4,930,010 A 5/1990 MacDonald
5,013,038 A 5/1991 Luvenberg
5,018,736 A 5/1991 Pearson et al.
5,035,422 A 7/1991 Berman
5,073,931 A 12/1991 Audebert et al.
5,083,271 A 1/1992 Thatcher et al.
5,083,800 A 1/1992 Lockton
5,119,295 A 6/1992 Kapur
5,120,076 A 6/1992 Luxenberg et al.
5,213,337 A 5/1993 Sherman
5,227,874 A 7/1993 Von Kohorn
5,256,863 A 10/1993 Ferguson
5,263,723 A 11/1993 Pearson et al.
5,283,734 A 2/1994 Von Kohorn
5,327,485 A 7/1994 Leaden
5,343,236 A 8/1994 Koppe et al.
5,343,239 A 8/1994 Lappington et al.
5,417,424 A 5/1995 Snowden
5,462,275 A 10/1995 Lowe et al.
5,479,492 A 12/1995 Hofstee et al.
5,488,659 A 1/1996 Millani
5,519,433 A 5/1996 Lappington
5,530,483 A 6/1996 Cooper
5,553,120 A 9/1996 Katz
5,566,291 A 10/1996 Boulton et al.
5,585,975 A 12/1996 Bliss
5,586,257 A 12/1996 Perlman
5,589,765 A 12/1996 Ohmart et al.
5,594,938 A 1/1997 Engel
5,618,232 A 4/1997 Martin
5,628,684 A 5/1997 Jean-Etienne
5,636,920 A 6/1997 Shur et al.
5,638,113 A 6/1997 Lappington
5,643,088 A 7/1997 Vaughn et al.
5,663,757 A 9/1997 Morales
5,759,101 A 6/1998 Won Kohorn
5,761,606 A 6/1998 Wolzien
5,762,552 A 6/1998 Voung et al.
5,764,275 A 6/1998 Lappington et al.
5,794,210 A 8/1998 Goldhaber et al.
5,805,230 A 9/1998 Staron
5,813,913 A 9/1998 Berner et al.
5,818,438 A 10/1998 Howe et al.
5,828,843 A 10/1998 Grimm
5,838,774 A 11/1998 Weiser, Jr.
5,838,909 A 11/1998 Roy
5,846,132 A 12/1998 Junkin
5,848,397 A 12/1998 Marsh et al.
5,860,862 A 1/1999 Junkin
5,894,556 A 4/1999 Grimm
5,916,024 A 6/1999 Von Kohorn
5,870,683 A 9/1999 Wells et al.
5,970,143 A 10/1999 Schneier et al.
5,971,854 A 10/1999 Pearson et al.
5,987,440 A 11/1999 O'Neil et al.
6,009,458 A 12/1999 Hawkins et al.
6,015,344 A 1/2000 Kelly et al.
6,016,337 A 1/2000 Pykalisto
6,038,599 A 3/2000 Black
6,042,477 A 3/2000 Addink
6,064,449 A 5/2000 White
6,104,815 A 8/2000 Alcorn et al.
6,110,041 A 8/2000 Walker et al.
6,117,013 A 9/2000 Elba
6,126,543 A 10/2000 Friedman
6,128,660 A 10/2000 Grimm
6,135,881 A 10/2000 Abbott et al.
6,154,131 A 11/2000 Jones, II
6,174,237 B1 1/2001 Stephenson
6,182,084 B1 1/2001 Cockrell et al.
6,193,610 B1 2/2001 Junkin
6,222,642 B1 4/2001 Farrell et al.
6,233,736 B1 5/2001 Wolzien
6,251,017 B1 6/2001 Leason et al.
6,263,447 B1 7/2001 French
6,267,670 B1 7/2001 Walker
6,287,199 B1 9/2001 McKeown et al.
6,293,868 B1 9/2001 Bernard
6,312,336 B1 11/2001 Handelman et al.
6,343,320 B1 1/2002 Fairchild
6,345,297 B1 2/2002 Grimm
6,371,855 B1 4/2002 Gavriloff
6,373,462 B1 4/2002 Pan
6,411,969 B1 6/2002 Tam
6,416,414 B1 7/2002 Stadelmann
6,418,298 B1 7/2002 Sonnenfeld
6,425,828 B2 7/2002 Walker et al.
6,434,398 B1 8/2002 Inselberg
6,446,262 B1 9/2002 Malaure et al.
6,470,180 B1 10/2002 Kotzin et al.
6,475,090 B2 11/2002 Gregory
6,524,189 B1 2/2003 Rautila
6,527,641 B1 3/2003 Sinclair et al.
6,530,082 B1 3/2003 Del Sesto et al.
6,536,037 B1 3/2003 Guheen et al.
6,578,068 B1 6/2003 Bowma-Amuah
6,594,098 B1 7/2003 Sutardja
6,604,997 B2 7/2003 Saidakovsky et al.
6,610,953 B1 8/2003 Tao et al.
6,611,755 B1 8/2003 Coffee
6,648,760 B1 11/2003 Nicastro
6,659,860 B1 12/2003 Yamamoto et al.
6,659,861 B1 12/2003 Faris
6,659,872 B1 12/2003 Kaufman et al.
6,690,661 B1 2/2004 Agarwal et al.
6,697,869 B1 2/2004 Mallart
6,718,350 B1 4/2004 Karbowski
6,752,396 B2 6/2004 Smith
6,758,754 B1 7/2004 Lavanchy et al.
6,758,755 B2 7/2004 Kelly et al.
6,760,595 B2 7/2004 Insellberg
6,763,377 B1 7/2004 Balknap et al.
6,766,524 B1 7/2004 Matheny et al.
6,774,926 B1 8/2004 Ellis et al.
6,785,561 B1 8/2004 Kim
6,801,380 B1 10/2004 Saturdja
6,806,889 B1 10/2004 Malaure et al.
6,807,675 B1 10/2004 Millard et al.
6,811,482 B2 11/2004 Letovsky
6,811,487 B2 11/2004 Sengoku
6,816,628 B1 11/2004 Sarachik et al.
6,817,947 B2 11/2004 Tanskanen
6,824,469 B2 11/2004 Allibhoy et al.
6,837,789 B2 1/2005 Garahi et al.
6,837,791 B1 1/2005 McNutt et al.
6,840,861 B2 1/2005 Jordan et al.
6,845,389 B1 1/2005 Sen
6,846,239 B2 1/2005 Washio
6,857,122 B1 2/2005 Takeda et al.
6,863,610 B2 3/2005 Vancraeynest
6,870,720 B2 3/2005 Iwata et al.
6,871,226 B1 3/2005 Ensley et al.
6,873,610 B1 3/2005 Noever
6,884,166 B2 4/2005 Leen et al.
6,884,172 B1 4/2005 Lloyd et al.
6,887,159 B2 5/2005 Leen et al.
6,888,929 B1 5/2005 Saylor
6,893,347 B1 5/2005 Zilliacus et al.
6,898,762 B2 5/2005 Ellis et al.
6,899,628 B2 5/2005 Leen et al.
6,903,681 B2 6/2005 Faris
6,908,389 B1 6/2005 Puskala
6,942,574 B1 9/2005 LeMay et al.
6,944,228 B1 9/2005 Dakss et al.
6,960,088 B1 11/2005 Long
6,978,053 B1 12/2005 Sarachik et al.
7,001,279 B1 2/2006 Barber et al.
7,029,394 B2 4/2006 Leen et al.
7,035,626 B1 4/2006 Luciano, Jr.
7,035,653 B2 4/2006 Simon et al.

(56) References Cited

U.S. PATENT DOCUMENTS 7,058,592 B1 6/2006 Heckerman et al.
7,076,434 B1 7/2006 Newman et al.
7,085,552 B2 8/2006 Buckley
7,116,310 B1 10/2006 Evans et al.
7,117,517 B1 10/2006 Milazzo et al.
7,120,924 B1 10/2006 Katcher et al.
7,124,410 B2 10/2006 Berg
7,125,336 B2 10/2006 Anttila et al.
7,136,871 B2 11/2006 Ozer et al.
7,144,011 B2 12/2006 Asher et al.
7,169,050 B1 1/2007 Tyler
7,185,355 B1 2/2007 Ellis
7,187,658 B2 3/2007 Koyanagi
7,191,447 B1 3/2007 Ellis et al.
7,192,352 B2 3/2007 Walker et al.
7,194,758 B1 3/2007 Waki et al.
7,228,349 B2 6/2007 Barone, Jr. et al.
7,231,630 B2 6/2007 Acott et al.
7,233,922 B2 6/2007 Asher et al.
7,240,093 B1 7/2007 Danieli et al.
7,244,181 B2 7/2007 Wang et al.
7,249,367 B2 7/2007 Bove, Jr. et al.
7,254,605 B1 8/2007 Strum
7,260,782 B2 8/2007 Wallace et al.
RE39,818 E 9/2007 Slifer
7,283,830 B2 10/2007 Buckley
7,288,027 B2 10/2007 Overton
7,341,517 B2 3/2008 Asher et al.
7,343,617 B1 3/2008 Kartcher et al.
7,347,781 B2 3/2008 Schultz
7,351,149 B1 4/2008 Simon et al.
7,367,042 B1 4/2008 Dakss et al.
7,379,705 B1 5/2008 Rados et al.
7,389,144 B1 6/2008 Osorio
7,430,718 B2 9/2008 Gariepy-Viles
7,452,273 B2 11/2008 Amaitis et al.
7,460,037 B2 12/2008 Cattone et al.
7,461,067 B2 12/2008 Dewing et al.
7,502,610 B2 3/2009 Maher
7,510,474 B2 3/2009 Carter, Sr.
7,517,282 B1 4/2009 Pryor
7,543,052 B1 6/2009 Cesa Klein
7,562,134 B1 7/2009 Fingerhut et al.
7,602,808 B2 10/2009 Ullmann
7,610,330 B1 10/2009 Quinn
7,534,169 B2 11/2009 Amaitis et al.
7,614,944 B1 11/2009 Hughes et al.
7,630,986 B1 12/2009 Herz et al.
7,693,781 B2 4/2010 Asher et al.
7,699,707 B2 4/2010 Bahou
7,702,723 B2 4/2010 Dyl
7,711,628 B2 5/2010 Davie et al.
7,729,286 B2 6/2010 Mishra
7,753,772 B1 7/2010 Walker
7,753,789 B2 7/2010 Walker et al.
7,780,528 B2 8/2010 Hirayama
7,828,661 B1 11/2010 Fish
7,835,961 B2 11/2010 Davie et al.
7,860,993 B2 12/2010 Chintala
7,886,003 B2 2/2011 Newman
7,907,211 B2 3/2011 Oostveen et al.
7,907,598 B2 3/2011 Anisimov
7,909,332 B2 3/2011 Root
7,925,756 B1 4/2011 Riddle
7,926,810 B2 4/2011 Fisher et al.
7,937,318 B2 5/2011 Davie et al.
7,941,482 B2 5/2011 Bates
7,941,804 B1 5/2011 Herington
7,951,002 B1 * 5/2011 Brosnan ..... G07F 17/3227 463/42
7,976,389 B2 7/2011 Cannon et al.
8,002,618 B1 8/2011 Lockton
8,006,314 B2 8/2011 Wold
8,025,565 B2 9/2011 Leen et al.
8,028,315 B1 9/2011 Barber
8,082,150 B2 12/2011 Wold
8,086,445 B2 12/2011 Wold et al.
8,086,510 B2 12/2011 Amaitis et al.
8,092,303 B2 1/2012 Amaitis et al.
8,092,306 B2 1/2012 Root
8,105,141 B2 1/2012 Leen et al.
8,107,674 B2 1/2012 Davis et al.
8,109,827 B2 2/2012 Cahill et al.
8,128,474 B2 3/2012 Amaitis et al.
8,147,313 B2 4/2012 Amaitis et al.
8,149,530 B1 4/2012 Lockton et al.
8,155,637 B2 4/2012 Fujisawa
8,162,759 B2 4/2012 Yamaguchi
8,176,518 B1 5/2012 Junkin et al.
8,186,682 B2 5/2012 Amaitis et al.
8,204,808 B2 6/2012 Amaitis et al.
8,219,617 B2 7/2012 Ashida
8,240,669 B2 8/2012 Asher et al.
8,246,048 B2 8/2012 Asher et al.
8,267,403 B2 9/2012 Fisher et al.
8,342,924 B2 1/2013 Leen et al.
8,342,942 B2 1/2013 Amaitis et al.
8,353,763 B2 1/2013 Amaitis et al.
8,376,855 B2 2/2013 Lockton et al.
8,396,001 B2 3/2013 Jung
8,397,257 B1 3/2013 Barber
8,465,021 B2 6/2013 Asher et al.
8,473,393 B2 6/2013 Davie et al.
8,474,819 B2 7/2013 Asher et al.
8,535,138 B2 9/2013 Amaitis et al.
8,538,563 B1 9/2013 Barber
8,543,487 B2 9/2013 Asher et al.
8,555,313 B2 10/2013 Newman
8,556,691 B2 10/2013 Leen et al.
8,585,490 B2 11/2013 Amaitis et al.
8,622,798 B2 1/2014 Lockton et al.
8,632,392 B2 1/2014 Shore et al.
8,634,943 B2 1/2014 Root
8,638,517 B2 1/2014 Lockton et al.
8,641,511 B2 2/2014 Ginsberg et al.
8,659,848 B2 2/2014 Lockton et al.
8,672,751 B2 3/2014 Leen et al.
8,699,168 B2 4/2014 Lockton et al.
8,705,195 B2 4/2014 Lockton
8,708,789 B2 4/2014 Asher et al.
8,717,701 B2 5/2014 Lockton et al.
8,727,352 B2 5/2014 Amaitis et al.
8,734,227 B2 5/2014 Leen et al.
8,737,004 B2 5/2014 Lockton et al.
8,738,694 B2 5/2014 Huske et al.
8,771,058 B2 7/2014 Alderucci et al.
8,780,482 B2 7/2014 Lockton et al.
8,805,732 B2 8/2014 Davie et al.
8,813,112 B1 8/2014 Cibula et al.
8,814,664 B2 8/2014 Amaitis et al.
8,817,408 B2 8/2014 Lockton et al.
8,837,072 B2 9/2014 Lockton et al.
8,849,225 B1 9/2014 Choti
8,849,255 B2 9/2014 Choti
8,858,313 B1 10/2014 Selfors
8,870,639 B2 10/2014 Lockton et al.
8,935,715 B2 1/2015 Cibula et al.
9,056,251 B2 6/2015 Lockton
9,067,143 B2 6/2015 Lockton et al.
9,069,651 B2 6/2015 Barber
9,076,303 B1 7/2015 Park
9,098,883 B2 8/2015 Asher et al.
9,111,417 B2 8/2015 Leen et al.
9,205,339 B2 12/2015 Cibula et al.
9,233,293 B2 1/2016 Lockton
9,258,601 B2 2/2016 Lockton et al.
9,270,789 B2 2/2016 Huske et al.
9,289,692 B2 3/2016 Barber
9,306,952 B2 4/2016 Burman et al.
9,314,686 B2 4/2016 Lockton
9,314,701 B2 4/2016 Lockton et al.
9,355,518 B2 5/2016 Amaitis et al.
9,406,189 B2 8/2016 Scott et al.
9,430,901 B2 8/2016 Amaitis et al.

(56) References Cited

U.S. PATENT DOCUMENTS 9,457,272 B2 10/2016 Lockton et al.
9,498,724 B2 11/2016 Lockton et al.
9,501,904 B2 11/2016 Lockton
9,504,922 B2 11/2016 Lockton et al.
9,511,287 B2 12/2016 Lockton et al.
9,526,991 B2 12/2016 Lockton et al.
9,536,396 B2 1/2017 Amaitis et al.
9,556,991 B2 1/2017 Furuya
9,604,140 B2 3/2017 Lockton et al.
9,652,937 B2 5/2017 Lockton
9,662,576 B2 5/2017 Lockton et al.
9,662,577 B2 5/2017 Lockton et al.
9,672,692 B2 6/2017 Lockton
9,687,738 B2 6/2017 Lockton et al.
9,687,739 B2 6/2017 Lockton et al.
9,707,482 B2 7/2017 Lockton et al.
9,716,918 B1 7/2017 Lockton et al.
9,724,603 B2 8/2017 Lockton et al.
9,744,453 B2 8/2017 Lockton et al.
9,805,549 B2 10/2017 Asher et al.
9,821,233 B2 11/2017 Lockton et al.
9,878,243 B2 1/2018 Lockton et al.
9,881,337 B2 1/2018 Jaycobs et al.
9,901,820 B2 2/2018 Lockton et al.
9,908,053 B2 3/2018 Lockton et al.
9,919,210 B2 3/2018 Lockton
9,919,211 B2 3/2018 Lockton et al.
9,919,221 B2 3/2018 Lockton et al.
9,978,217 B2 5/2018 Lockton
9,993,730 B2 6/2018 Lockton et al.
9,999,834 B2 6/2018 Lockton et al.
10,052,557 B2 8/2018 Lockton et al.
10,089,815 B2 10/2018 Asher et al.
10,096,210 B2 10/2018 Amaitis et al.
10,137,369 B2 11/2018 Lockton et al.
10,150,031 B2 12/2018 Lockton et al.
10,165,339 B2 12/2018 Huske et al.
10,186,116 B2 1/2019 Lockton
10,195,526 B2 2/2019 Lockton et al.
10,226,698 B1 3/2019 Lockton et al.
10,226,705 B2 3/2019 Lockton et al.
10,232,270 B2 3/2019 Lockton et al.
10,248,290 B2 4/2019 Galfond
10,279,253 B2 5/2019 Lockton
10,360,767 B2 7/2019 Russell et al.
10,410,474 B2 * 9/2019 Lockton ..... G07F 17/3276
10,438,451 B2 * 10/2019 Amaitis ..... G07F 17/3244
10,569,175 B2 2/2020 Kosai et al.
10,593,157 B2 * 3/2020 Simons ..... H04L 9/3226
10,825,294 B2 * 11/2020 Katz ..... G07F 17/3244
10,937,279 B1 * 3/2021 Workman ..... G07F 17/3239
11,077,366 B2 * 8/2021 Lockton ..... H04N 21/2385
11,082,746 B2 * 8/2021 Lockton ..... A63F 13/355
11,083,965 B2 * 8/2021 Lockton ..... A63F 13/50
11,179,632 B2 * 11/2021 Lockton ..... H04N 5/04
11,185,770 B2 * 11/2021 Lockton ..... A63F 13/332
2001/0004609 A1 6/2001 Walker et al.
2001/0005670 A1 6/2001 Lahtinen
2001/0013067 A1 8/2001 Koyanagi
2001/0013125 A1 8/2001 Kitsukawa et al.
2001/0020298 A1 9/2001 Rector, Jr. et al.
2001/0032333 A1 10/2001 Flickinger
2001/0036272 A1 11/2001 Hirayama
2001/0036853 A1 11/2001 Thomas
2001/0044339 A1 11/2001 Cordero
2001/0054019 A1 12/2001 de Fabrega
2002/0010789 A1 1/2002 Lord
2002/0018477 A1 2/2002 Katz
2002/0026321 A1 2/2002 Faris
2002/0029381 A1 3/2002 Inselberg
2002/0035609 A1 3/2002 Lessard
2002/0037766 A1 3/2002 Muniz
2002/0069265 A1 3/2002 Bountour
2002/0042293 A1 4/2002 Ubale et al.
2002/0046099 A1 4/2002 Frengut et al.
2002/0054088 A1 5/2002 Tanskanen et al.
2002/0055385 A1 5/2002 Otsu
2002/0056089 A1 5/2002 Houston
2002/0059094 A1 5/2002 Hosea et al.
2002/0059623 A1 5/2002 Rodriguez et al.
2002/0069076 A1 6/2002 Faris
2002/0076084 A1 6/2002 Tian
2002/0078176 A1 6/2002 Nomura et al.
2002/0083461 A1 6/2002 Hutcheson
2002/0091833 A1 7/2002 Grimm
2002/0094869 A1 7/2002 Harkham
2002/0095333 A1 7/2002 Jokinen et al.
2002/0097983 A1 7/2002 Wallace et al.
2002/0099709 A1 7/2002 Wallace
2002/0100063 A1 7/2002 Herigstad et al.
2002/0103696 A1 8/2002 Huang et al.
2002/0105535 A1 8/2002 Wallace et al.
2002/0107073 A1 8/2002 Binney
2002/0108112 A1 8/2002 Wallace et al.
2002/0108125 A1 8/2002 Joao
2002/0108127 A1 8/2002 Lew et al.
2002/0112249 A1 8/2002 Hendricks et al.
2002/0115488 A1 8/2002 Berry et al.
2002/0119821 A1 8/2002 Sen
2002/0120930 A1 8/2002 Yona
2002/0124247 A1 9/2002 Houghton
2002/0132614 A1 9/2002 Vanlujit et al.
2002/0133817 A1 9/2002 Markel
2002/0133827 A1 9/2002 Newman et al.
2002/0142843 A1 10/2002 Roelofs
2002/0144273 A1 10/2002 Reto
2002/0147049 A1 10/2002 Carter, Sr.
2002/0157002 A1 10/2002 Messerges et al.
2002/0157005 A1 10/2002 Brunk
2002/0159576 A1 10/2002 Adams
2002/0162031 A1 10/2002 Levin et al.
2002/0162117 A1 10/2002 Pearson
2002/0165020 A1 11/2002 Koyama
2002/0165025 A1 11/2002 Kawahara
2002/0177483 A1 11/2002 Cannon
2002/0184624 A1 12/2002 Spencer
2002/0187825 A1 12/2002 Tracy
2002/0198050 A1 12/2002 Patchen
2003/0002638 A1 1/2003 Kaars
2003/0003997 A1 1/2003 Vuong et al.
2003/0013528 A1 1/2003 Allibhoy et al.
2003/0023547 A1 1/2003 France
2003/0040363 A1 2/2003 Sandberg
2003/0054885 A1 3/2003 Pinto et al.
2003/0060247 A1 3/2003 Goldberg et al.
2003/0066089 A1 4/2003 Anderson
2003/0069828 A1 4/2003 Blazey et al.
2003/0070174 A1 4/2003 Solomon
2003/0078924 A1 4/2003 Liechty et al.
2003/0086691 A1 5/2003 Yu
2003/0087652 A1 5/2003 Simon et al.
2003/0088648 A1 5/2003 Bellaton
2003/0114224 A1 6/2003 Anttila et al.
2003/0115152 A1 6/2003 Flaherty
2003/0125109 A1 7/2003 Green
2003/0134678 A1 7/2003 Tanaka
2003/0144017 A1 7/2003 Inselberg
2003/0154242 A1 8/2003 Hayes et al.
2003/0165241 A1 9/2003 Fransdonk
2003/0177167 A1 9/2003 Lafage et al.
2003/0177504 A1 9/2003 Paulo et al.
2003/0189668 A1 10/2003 Newman et al.
2003/0195023 A1 10/2003 Di Cesare
2003/0195807 A1 10/2003 Maggio
2003/0208579 A1 11/2003 Brady et al.
2003/0211856 A1 11/2003 Zilliacus
2003/0212691 A1 11/2003 Kuntala et al.
2003/0216185 A1 11/2003 Varley
2003/0216857 A1 11/2003 Feldman et al.
2003/0228866 A1 12/2003 Pezeshki
2003/0233425 A1 12/2003 Lyons et al.
2004/0005919 A1 1/2004 Walker et al.
2004/0014524 A1 1/2004 Pearlman
2004/0015442 A1 1/2004 Hmlinen

(56) References Cited

U.S. PATENT DOCUMENTS

2004/0022366 A1 2/2004 Ferguson et al.
2004/0025190 A1 2/2004 McCalla
2004/0056897 A1 3/2004 Ueda
2004/0060063 A1 3/2004 Russ et al.
2004/0073915 A1 4/2004 Dureau
2004/0088729 A1 5/2004 Petrovic et al.
2004/0093302 A1 5/2004 Baker et al.
2004/0152454 A1 5/2004 Kauppinen
2004/0107138 A1 6/2004 Maggio
2004/0117831 A1 6/2004 Ellis et al.
2004/0117839 A1 6/2004 Watson et al.
2004/0125877 A1 7/2004 Chang
2004/0128319 A1 7/2004 Davis et al.
2004/0139158 A1 7/2004 Datta
2004/0139482 A1 7/2004 Hale
2004/0148638 A1 7/2004 Weisman et al.
2004/0152517 A1 8/2004 Haedisty
2004/0152519 A1 8/2004 Wang
2004/0158855 A1 8/2004 Gu et al.
2004/0162124 A1 8/2004 Barton
2004/0166873 A1 8/2004 Simic
2004/0176162 A1 9/2004 Rothschild
2004/0178923 A1 9/2004 Kuang
2004/0183824 A1 9/2004 Benson
2004/0185881 A1 9/2004 Lee
2004/0190779 A1 9/2004 Sarachik et al.
2004/0198495 A1 10/2004 Cisneros et al.
2004/0201626 A1 10/2004 Lavoie
2004/0203667 A1 10/2004 Shroder
2004/0203898 A1 10/2004 Bodin et al.
2004/0210507 A1 10/2004 Asher et al.
2004/0215756 A1 10/2004 VanAntwerp
2004/0216161 A1 10/2004 Barone, Jr. et al.
2004/0216171 A1 10/2004 Barone, Jr. et al.
2004/0224750 A1 11/2004 Ai-Ziyoud
2004/0242321 A1 12/2004 Overton
2004/0266513 A1* 12/2004 Odom ..... G06Q 50/34
463/17
2005/0005303 A1 1/2005 Barone et al.
2005/0021942 A1 1/2005 Diehl et al.
2005/0026699 A1 2/2005 Kinzer et al.
2005/0028208 A1 2/2005 Ellis
2005/0043094 A1 2/2005 Nguyen et al.
2005/0076371 A1 4/2005 Nakamura
2005/0077997 A1 4/2005 Landram
2005/0060219 A1 5/2005 Ditering et al.
2005/0097599 A1 5/2005 Potnick et al.
2005/0101309 A1 5/2005 Croome
2005/0113164 A1 5/2005 Buecheler et al.
2005/0003878 A1 6/2005 Updike
2005/0131984 A1 6/2005 Hofmann et al.
2005/0138668 A1 6/2005 Gray et al.
2005/0144102 A1 6/2005 Johnson
2005/0155083 A1 7/2005 Oh
2005/0177861 A1 8/2005 Ma et al.
2005/0210526 A1 9/2005 Levy et al.
2005/0216838 A1 9/2005 Graham
2005/0235043 A1 10/2005 Teodosiu et al.
2005/0239551 A1 10/2005 Griswold
2005/0255901 A1 11/2005 Kreutzer
2005/0256895 A1 11/2005 Dussault
2005/0266869 A1 12/2005 Jung
2005/0267969 A1 12/2005 Poikselka et al.
2005/0273804 A1 12/2005 Preisman
2005/0283800 A1 12/2005 Ellis et al.
2005/0288080 A1 12/2005 Lockton et al.
2005/0288101 A1 12/2005 Lockton et al.
2005/0288812 A1 12/2005 Cheng
2006/0020700 A1 1/2006 Qiu
2006/0025070 A1 2/2006 Kim et al.
2006/0046810 A1 3/2006 Tabata
2006/0047772 A1 3/2006 Crutcher
2006/0053390 A1 3/2006 Gariepy-Viles
2006/0058103 A1 3/2006 Danieli
2006/0059161 A1 3/2006 Millett et al.
2006/0063590 A1 3/2006 Abassi et al.
2006/0082068 A1 4/2006 Patchen
2006/0087585 A1 4/2006 Seo
2006/0089199 A1 4/2006 Jordan et al.
2006/0094409 A1 5/2006 Inselberg
2006/0101492 A1 5/2006 Lowcock
2006/0111168 A1 5/2006 Nguyen
2006/0135253 A1 6/2006 George et al.
2006/0148569 A1 7/2006 Beck
2006/0156371 A1 7/2006 Maetz et al.
2006/0160597 A1 7/2006 Wright
2006/0174307 A1 8/2006 Hwang et al.
2006/0183547 A1 8/2006 McMonigle
2006/0183548 A1 8/2006 Morris et al.
2006/0190654 A1 8/2006 Joy
2006/0205483 A1 9/2006 Meyer et al.
2006/0205509 A1 9/2006 Hirota
2006/0205510 A1 9/2006 Lauper
2006/0217198 A1 9/2006 Johnson
2006/0236352 A1 10/2006 Scott, III
2006/0248553 A1 11/2006 Mikkelson et al.
2006/0248564 A1 11/2006 Zinevitch
2006/0256865 A1 11/2006 Westerman
2006/0256868 A1 11/2006 Westerman
2006/0269120 A1 11/2006 Mehmadi et al.
2006/0285586 A1 12/2006 Westerman
2007/0004516 A1 1/2007 Jordan et al.
2007/0013547 A1 1/2007 Boaz
2007/0019826 A1 1/2007 Horbach et al.
2007/0028272 A1 2/2007 Lockton
2007/0037623 A1 2/2007 Romik
2007/0054695 A1 3/2007 Huske et al.
2007/0078009 A1 4/2007 Lockton et al.
2007/0083920 A1 4/2007 Mizoguchi et al.
2007/0086465 A1 4/2007 Paila et al.
2007/0087832 A1 4/2007 Abbott
2007/0093296 A1 4/2007 Asher
2007/0101358 A1 5/2007 Ambady
2007/0106721 A1 5/2007 Schloter
2007/0107010 A1 5/2007 Jolna et al.
2007/0129144 A1 6/2007 Katz
2007/0147870 A1 7/2007 Nagashima et al.
2007/0162328 A1 7/2007 Reich
2007/0183744 A1 8/2007 Koizumi
2007/0197247 A1 8/2007 Inselberg
2007/0210908 A1 9/2007 Putterman et al.
2007/0219856 A1 9/2007 Ahmad-Taylor
2007/0222652 A1 9/2007 Cattone et al.
2007/0226062 A1 9/2007 Hughes et al.
2007/0238525 A1 10/2007 Suomela
2007/0243936 A1 10/2007 Binenstock et al.
2007/0244570 A1 10/2007 Speiser et al.
2007/0244585 A1 10/2007 Speiser et al.
2007/0244749 A1 10/2007 Speiser et al.
2007/0265089 A1 11/2007 Robarts
2007/0294410 A1 12/2007 Pandya
2008/0005037 A1 1/2008 Hammad
2008/0013927 A1 1/2008 Kelly et al.
2008/0051201 A1 2/2008 Lore
2008/0066129 A1 3/2008 Katcher et al.
2008/0076497 A1 3/2008 Kiskis et al.
2008/0104630 A1 5/2008 Bruce
2008/0146337 A1 6/2008 Halonen
2008/0169605 A1 7/2008 Shuster et al.
2008/0222672 A1 9/2008 Piesing
2008/0240681 A1 10/2008 Fukushima
2008/0248865 A1 10/2008 Tedesco
2008/0270288 A1 10/2008 Butterly et al.
2008/0288600 A1 11/2008 Clark
2009/0011781 A1 1/2009 Merrill et al.
2009/0094632 A1 4/2009 Newman et al.
2009/0103892 A1 4/2009 Hirayama
2009/0186676 A1 7/2009 Amaitis et al.
2009/0163271 A1 9/2009 George et al.
2009/0228351 A1 9/2009 Rijsenbrij
2009/0234674 A1 9/2009 Wurster
2009/0264188 A1 10/2009 Soukup
2009/0271512 A1 10/2009 Jorgensen
2009/0325716 A1 12/2009 Harari

(56) References Cited

U.S. PATENT DOCUMENTS

2010/0099421 A1 4/2010 Patel et al.
2010/0099471 A1 4/2010 Feeney et al.
2010/0107194 A1 4/2010 McKissick et al.
2010/0120503 A1 5/2010 Hoffman et al.
2010/0137057 A1 6/2010 Fleming
2010/0203936 A1 8/2010 Levy
2010/0279764 A1 11/2010 Allen et al.
2010/0296511 A1 11/2010 Prodan
2011/0016224 A1 1/2011 Riley
2011/0053681 A1 3/2011 Goldman
2011/0065490 A1* 3/2011 Lutnick ..... G07F 17/32 463/16
2011/0081958 A1 4/2011 Herman
2011/0116461 A1 5/2011 Holt
2011/0130197 A1 6/2011 Bythar et al.
2011/0227287 A1 9/2011 Reabe
2011/0269548 A1 11/2011 Barclay et al.
2011/0306428 A1 12/2011 Lockton et al.
2012/0058808 A1 3/2012 Lockton
2012/0115585 A1 5/2012 Goldman
2012/0157178 A1 6/2012 Lockton
2012/0264496 A1 10/2012 Behrman et al.
2012/0282995 A1 11/2012 Allen et al.
2012/0295686 A1 11/2012 Lockton
2013/0005453 A1 1/2013 Nguyen et al.
2013/0072271 A1 3/2013 Lockton et al.
2013/0079081 A1 3/2013 Lockton et al.
2013/0079092 A1 3/2013 Lockton et al.
2013/0079093 A1 3/2013 Lockton et al.
2013/0079135 A1 3/2013 Lockton et al.
2013/0079150 A1 3/2013 Lockton et al.
2013/0079151 A1 3/2013 Lockton et al.
2013/0196774 A1 8/2013 Lockton et al.
2013/0225285 A1 8/2013 Lockton
2013/0225299 A1 8/2013 Lockton
2014/0031134 A1 1/2014 Lockton et al.
2014/0100011 A1 4/2014 Gingher
2014/0106832 A1 4/2014 Lockton et al.
2014/0128139 A1 5/2014 Shuster et al.
2014/0155130 A1 6/2014 Lockton et al.
2014/0155134 A1 6/2014 Lockton
2014/0206446 A1 7/2014 Lockton et al.
2014/0237025 A1 8/2014 Huske et al.
2014/0248952 A1 9/2014 Cibula et al.
2014/0256432 A1 9/2014 Lockton et al.
2014/0279439 A1 9/2014 Brown
2014/0287832 A1 9/2014 Lockton et al.
2014/0309001 A1 10/2014 Root
2014/0335961 A1 11/2014 Lockton et al.
2014/0335962 A1 11/2014 Lockton et al.
2014/0378212 A1 12/2014 Sims
2015/0011310 A1 1/2015 Lockton et al.
2015/0024814 A1 1/2015 Root
2015/0067732 A1 3/2015 Howe et al.
2015/0148130 A1 5/2015 Cibula et al.
2015/0238839 A1 8/2015 Lockton
2015/0238873 A1 8/2015 Arnone et al.
2015/0258452 A1 9/2015 Lockton et al.
2015/0356831 A1 12/2015 Osibodu
2016/0023116 A1 1/2016 Wire
2016/0045824 A1 2/2016 Lockton et al.
2016/0049049 A1 2/2016 Lockton
2016/0054872 A1 2/2016 Cibula et al.
2016/0082357 A1 3/2016 Lockton
2016/0121208 A1 5/2016 Lockton et al.
2016/0134947 A1 5/2016 Huske et al.
2016/0217653 A1 7/2016 Beyer
2016/0271501 A1 9/2016 Balsbaugh
2016/0361647 A1 12/2016 Lockton et al.
2016/0375362 A1 12/2016 Lockton et al.
2017/0036110 A1 2/2017 Lockton et al.
2017/0036117 A1 2/2017 Lockton et al.
2017/0043259 A1 2/2017 Lockton et al.
2017/0053498 A1 2/2017 Lockton
2017/0065891 A1 3/2017 Lockton et al.
2017/0098348 A1* 4/2017 Odom ..... G07F 17/3288
2017/0103615 A1 4/2017 Theodospoulos
2017/0128840 A1 5/2017 Croci
2017/0221314 A1 8/2017 Lockton
2017/0225071 A1 8/2017 Lockton et al.
2017/0225072 A1 8/2017 Lockton et al.
2017/0232340 A1 8/2017 Lockton
2017/0243438 A1 8/2017 Merati
2017/0249801 A1* 8/2017 Malek ..... G07F 17/3211
2017/0252649 A1 9/2017 Lockton et al.
2017/0259173 A1 9/2017 Lockton et al.
2017/0264961 A1 9/2017 Lockton
2017/0282067 A1 10/2017 Lockton et al.
2017/0296916 A1 10/2017 Lockton et al.
2017/0304726 A1 10/2017 Lockton et al.
2017/0345260 A1* 11/2017 Strause ..... G07F 17/3267
2018/0025586 A1 1/2018 Lockton
2018/0071637 A1 3/2018 Baazov
2018/0104582 A1 4/2018 Lockton et al.
2018/0104596 A1 4/2018 Lockton et al.
2018/0117464 A1 5/2018 Lockton et al.
2018/0140955 A1 5/2018 Lockton et al.
2018/0154255 A1 6/2018 Lockton
2018/0169523 A1 6/2018 Lockton et al.
2018/0190077 A1 7/2018 Hall
2018/0236359 A1 8/2018 Lockton et al.
2018/0243652 A1 8/2018 Lockton et al.
2018/0264360 A1 9/2018 Lockton et al.
2018/0300988 A1 10/2018 Lockton
2018/0318710 A1 11/2018 Lockton et al.
2019/0054375 A1 2/2019 Lockton et al.
2019/0060750 A1 2/2019 Lockton et al.
2019/0143225 A1 5/2019 Baazov
2019/0295382 A1* 9/2019 Huke ..... G07F 17/3288
2019/0304259 A1* 10/2019 Joao ..... G06Q 50/34
2020/0111325 A1* 4/2020 Lockton ..... G07F 17/3288
2021/0043036 A1* 2/2021 Katz ..... G07F 17/3248
2021/0099759 A1* 4/2021 Armstrong ..... H04N 21/2547
2021/0136456 A1* 5/2021 Srinivasan ..... G07F 17/3288
2021/0142620 A1* 5/2021 Platis ..... G07F 17/3237
2021/0260476 A1* 8/2021 Lockton ..... H04N 5/04

FOREIGN PATENT DOCUMENTS

CA 2279069 7/1999
CA 2287617 10/1999
EP 0649102 A3 6/1996
GB 2364485 1/2002
JP 11-46356 2/1999
JP 11-239183 8/1999
JP 2000-165840 6/2000
JP 2000-217094 8/2000
JP 2000-358255 12/2000
JP 2001-28743 1/2001
JP 2000-209563 7/2008
NZ 330242 10/1989
WO 01/039506 A2 5/2001
WO 01/65743 A1 9/2001
WO 02/03698 A1 10/2002
WO 2005064506 A1 7/2005
WO 2006004855 1/2006
WO 2006004856 1/2006
WO 2007002284 1/2007
WO 2007016575 2/2007
WO 2007041667 4/2007
WO 2008027811 A2 3/2008
WO 2008115858 A1 9/2008

OTHER PUBLICATIONS

'Ark 4.0 Standard Edition, Technical Overview' www.twowaytv.com/version4/technologies/tech_ark_professionals.asp.

"Understanding the Interactivity Between Television and Mobile commerce", Robert Davis and David Yung, Communications of the ACM, Jul. 2005, vol. 48, No. 7, pp. 103-105.

"Re: Multicast Based Voting System" www.ripe.net/ripe/maillists/archives/mbone-eu-op/1997/msg00100html.

(56) References Cited

OTHER PUBLICATIONS

"IST and Sportal.com: Live on the Internet Sep. 14, 2004 by Clare Spoonheim", www.isk.co.usk/NEWS/dotcom/ist_sportal.html.
"Modeling User Behavior in Networked Games byTristan Henderson and Saleem Bhatti", www.woodworm.cs.uml.edu/rprice/ep/henderson.
"SMS Based Voting and Survey System for Meetings", www.abbit.be/technology/SMSSURVEY.html.
"PurpleAce Launches 3GSM Ringtone Competition", www.wirelessdevnet.com/news/2005/jan/31/news6html.
"On the Perfomance of Protocols for collecting Responses over a Multiple-Access Channel", Mostafa H. Ammar and George N. Rouskas, IEEE INCOMFORM '91, pp. 1490-1499, vol. 3, IEEE, New York, NY.
Merriam-Webster, "Game" definition, <http://www.merriam-webster.com/dictionary/agme.pg.1.
Ducheneaut et al., "The Social Side of Gaming: A Study of Interaction Patterns in a Massively Multiplayer Online Game", Palo Alto Research Center, Nov. 2004, vol. 6, Issue 4, pp. 360-369.
http://help.yahoo.com/help/us/tourn/tourn-03.html.
Pinnacle,"The basics of reverse line movement," Jan. 19, 2018, Retrieved on Jan. 22, 2020 , http://www.pinnacle.com/en/betting-articles educational/basics-of-reverse-line-movement/QAH26XGGQQS7M3GD.
Gambling Commission,"Virtual currencies, eSports and social casino gaming-position paper," Mar. 2017, Retrieved on Jan. 22, 2020, http://gamblingcomission.gov.uk/PDF/Virtual-currencies-eSports-and -social-casino-gaming.pdf.
Sipko et al.,"Machine learning for the prediction of professional tennis matches," In: MEng computing-final year project, Imperial College London, Jun. 15, 2015, http://www.doc.ic.ac.uk/teaching/distinguished-projects/2015/rn.sipko.pdf.
WinView Game Producer, "Live TV Sports Play Along App WinView Games Announces Sponsorship With PepsiCo to Start This Holiday Season," In Winview Games. Dec. 21, 2016, Retrieved on Jan. 21, 2020 from , http://www. winviewgames./press-release/live-tv-sports-play-along-app-winview-games-announces-sponsorship-pepsico-start-holiday-season/.
The International Search Report and the Written Opinion for the PCT/US2019/054859 dated Feb. 4, 2020.
The International Preliminary Report dated Apr. 22, 2021 for the application PCT/US2019/054859.

* cited by examiner

METHOD AND SYSTEMS FOR REDUCING RISK IN SETTING ODDS FOR SINGLE FIXED IN-PLAY PROPOSITIONS UTILIZING REAL TIME INPUT

CROSS-REFERENCE TO RELATED APPLICATION(S)

This application claims the benefit of U.S. Provisional Patent Application Ser. No. 62/742,593, filed Oct. 8, 2018 and titled "METHOD AND SYSTEMS FOR REDUCING RISK IN SETTING ODDS FOR SINGLE FIXED IN PLAY PROPOSITIONS UTILIZING REAL TIME INPUT," which is hereby incorporated by reference in its entirety for all purposes.

FIELD OF THE INVENTION

The present invention relates to the field of computer analysis. More specifically, the present invention relates to the field of computer analysis related to gaming.

BACKGROUND OF THE INVENTION

With repeal of PASPA, sports betting in the U.S. is projected to be ultimately legalized in up to 33 states in the next ten years, with over $60-100 billion projected to generate in gross gaming revenues from live In-Play or In Running wagers. Live betting already constitutes over 70% of the estimated $175 billion sports betting industry.

For sports betting companies such as consumer facing William Hill, MGM, or live betting data suppliers such as Betradar and BetGenius, the challenges in generating consistent profit margins on wagers while games are in progress are different than the challenges facing a cash skill game provider such as WinView—www.winviewgames.com. With WinView's proposition based legal games of skill, the accuracy of the odds set on "Yes" "No" In-Play propositions produced by WinView's live producers have no effect on WinView's revenues. WinView conducts paid entry contests and tournaments of skill between the entrants and charges a set management fee or "rake" for providing the service. Their fee is the same regardless of the outcome of a single proposition or multiple propositions in the contests of skill.

In traditional legalized pre-game fixed odds "outcome" betting, ("Who will win the first half"?) the bookmaker generally adjusts the odds as the bets are booked, with a goal of balancing its financial risk of being on the wrong side of an unbalanced book. Having all wagers placed on one team would cause potential catastrophic losses if that team won, because unlike in the WinView skill game system, each individual bet is against the house. For traditional pre-game outcome betting, e.g., "who will win?" with points spreads, "over and under" points, bookmakers attempt to balance odds based on the amount of money wagered on the two (or more) options of the wager with the goal of putting the bookmaker in a position where they are indifferent to which side of the wager pays off. This is accomplished by adjusting the odds to attract wagers on the less favored side of the proposition. The following article is hereby incorporated by reference in its entirety: https://betting.betfair.com/the-art-of-bookmaking.html as background on how this kind of bookmaking works.

The Problem for In-Play Betting

In live sports betting, unlike WinView, the punter is wagering directly against the house. The more frequently live betting propositions are produced, the more potential profit. Bookmakers presenting live betting must think and work quickly to optimize accuracy in selecting the appropriate situational proposition and then set the accompanying odds to optimize returns immediately and present it to the bettors. This is extremely challenging. Each game is unique, and each moment of the game lends itself to a unique question about "what is going to happen next." The closer a live proposition is to what the collective viewing audience is thinking about what's going to happen next, the more participation it will generate. Entertaining and entrancing propositions are customized to the immediate situation on the field and are often unique one of a kind. With legal sports books, however, the frequency and relevancy of the live propositions to be presented are restricted by the risk they involve.

With no prior historical data on the exact game situation, and without any knowledge of the betting TV audience's collective wisdom expressed by actual "voting" with their wallets on a proposition as with pre game outcome betting, optimally setting the odds for each unique short-term In-Play proposition under severe time pressure is currently based on the level of sophistication, relevancy, speed and accuracy of the data and sophisticated software systems, combined with subjective judgment of the live bookmakers.

As referenced below, "In Running" betting is the term utilized herein to describe wagers where the wording of the proposition is unchanged after offered, e.g., "Who will win the first quarter?" With each major change in the probabilities created through, for example, a score in a soccer game, the acceptance of new wagers is briefly suspended at the server while the new odds are recalculated and betting on that proposition is reopened with new odds.

With the "In-Play" version of live bookmaking, unlike traditional outcome betting, the permanent odds for each successive proposition must be quickly set without any direct feedback about the betting audience's collective betting response as the game action continues. The fundamental method of risk elimination for non-live outcome bookmaking, as described in the previous paragraph is not available, and the lockout for that proposition comes within a matter of seconds after presentation.

Live In-Play bookmakers, in order to maximize the TV betting audience's collective focus on the "in the moment" game state, generate an In-Play proposition that reflects the unique and generally one-of-a kind game situation—("Will the Colts score on the next play?"—"Will the ruling on the field be overturned?") and depending on the sport, set the odds within 5-10 seconds, varying by whether there is, for example, a time out, commercial break, replay, injury or ongoing action as in soccer. Today live book makers utilize a combination of AI driven computer programs utilizing machine learning and neural networks which rely on historic performance data and probabilities, real time analysis of the in progress game's statistics, historical data on the experience with the same or similar proposition, analysis of competitor bookmakers odds, and human experts who evaluate all these sources available and the computer systems' recommendations. Finally, the bookmakers optionally utilize their own judgment to modify or select the recommended odds, within a matter of seconds. One bookmaker's methods are reflective of the industry are described in Appendix A of the U.S. Provisional Patent Application No. 62/742,593, an article from the EGM Sports Betting 2017 report referenced above. This method limits not only the frequency, but also the flexibility and creativity in creating live customized propositions by limiting the live betting possibilities to a pre-produced standard list where sufficient historic data exists to yield AI computer generated odds with an acceptable risk factor. The result is fewer, more repetitive generic propositions and the desired maximization of return is not infrequently achieved.

SUMMARY OF THE INVENTION

A real-time, two screen skill game operator like WinView, presents propositions to the viewing audience, and based on the collective predictive input received from those propositions, comparable In-Play sports betting propositions are able to be generated, and the odds of the In-Play betting propositions are able to be adjusted based on the actual reaction of the same audience of potential customers to input received from the skill game operator's propositions to optimize the separate single proposition's odds.

DETAILED DESCRIPTION OF THE PREFERRED EMBODIMENT

Figure 1:
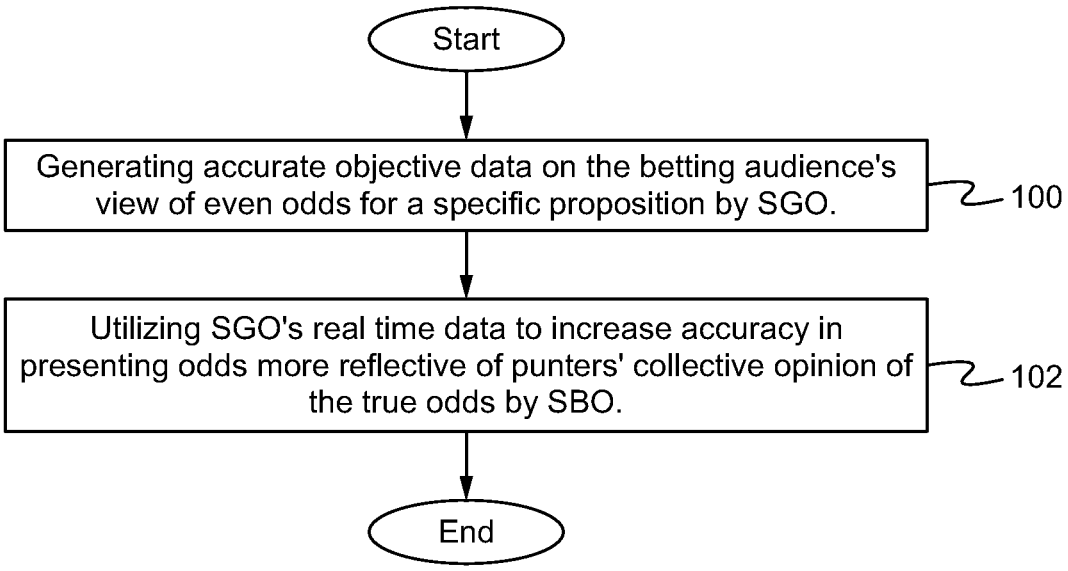
FIG. 1 illustrates a flowchart of a method of utilizing SGO data to optimize SBO propositions according to some embodiments.

A skill cash game operator offering proposition-based games of skill based on the overall performance over a set of 20-30 propositions in a skill contest like WinView offers is referred to as an "SGO" for Skill Game Operator. A legal sports book offering live betting will be referred to as an "SBO" or Sports Betting Operator.

Real time analytics programs utilizing real time data for individual and team on the on-field performances, combined with massive historical statistics relative to the probability of a specific In-Play betting proposition important to In-Play bookmaking is an important innovation in live fixed-odd bookmaking. For example, for a proposition on the likelihood of the Patriots, playing the Colts at home, to score on a possession within the "Red Zone," the system can generate odds for each proposition sufficiently accurate enough to substantially reduce financial exposure. But these odds will not be consistently as effective in achieving the ideal of a 50/50 split on the "Yes" or "No" amounts wagered, or optimize the bookmakers return, as unlike outcome betting, the bookmaker's odds can only be set once in a matter of seconds, and bets cannot be accepted until the proposition with these fixed odds are published. In In Running wagers, bookmakers immediately see the response to the odds and as the contest unfolds, can close or lock out the previous proposition and course correct by offering new odds proposed by their Artificial Intelligence (AI) systems, constantly maximizing potential return for this segment of live betting. The bookmakers' most fundamental tool in traditional pre-match outcome betting: the ability to utilize actual bets placed on the current odds offered to adjust the odds to balance the book, or to lay off or hedge their portfolio, is not available.

In a hypothetically ideal system, a live sports bookmaker might be able, after utilizing all the expert systems and real-time tools at their disposal, to set the "initial" odds for an In-Play proposition, and present these preliminary odds to the existing betting universe for that proposition. Then, based on the collective response of this actual wagering market, revealing the wisdom of the actual universe of the skilled and unskilled punters, the exact target for the SBO, the bookmaker would feed the actual result data received on how the skill game competitors collectively responded to the originally proffered odds into an AI-based software system to instantly recalculate significantly more accurate, if not optimal odds. These new empirically adjusted odds would then be formally presented to the same betting universe as the actual betting odds, and all of this is accomplished in a timely manner which does not antagonize the betting audience.

Described herein are the methods and systems to optimize InPlay wagering returns utilizing the capabilities of a Skill Game Operator's (SGO) paid entry contests of skill such as WinView's, to provide an In-Play wagering service offered by a Sports Betting Operator (SBO) with the optimum odds setting capability for In-Play wagers, offered simultaneously to the same audience for the televised athletic or other type of contest being offered by both services.

As used herein, propositions are able to be generated for sports events, esports events, athletic events, non-athletic events and occurrences, televised events and occurrences, live events and occurrences and recorded events and occurrences.

Overview

The primary application of the system utilizes the direct cooperation of the "SGO" and the "SBO." The SGO's live game producers, following its In-Play proposition setting procedures would generate the wording of the contemplated live proposition, arbitrarily setting what their data and experience indicates has a probability of achieving as close as possible to a 50/50% distribution between "Yes" and "No." Immediately after the proposition is published, the SGO's audience begins to "vote" with their predictions on the "yes" or "no" wagers at the odds that were set in real time by the SGO's audience, for example, "Will the Patriots score on this drive?" If in setting these odds, from their prior data and experience, the SGO's human bookmakers (game producers) determined the true odds were 40% "Yes" and 60% "No," the odds for one betting unit would be "2.5" for "Yes" and "1.67" for "No."

Simultaneously, the SBO (with or without the teachings herein) is utilizing their sophisticated AI computer systems dedicated to coming as close as possible to optimizing their financial return on the yes/no option of a proposition using identical wording. But, the most sophisticated real time data tools and software, even utilizing analysis of the unfolding game statistics to get a sense of what the viewing audience thinks the probabilities are, does not come close to the actual audience's behavior these systems are attempting to predict. The only way to predict such complex behavior is to capture the actual response of the identical targeted television audience displaying the "wisdom of crowds." This wisdom in turn results from the potential betting audience observing and experiencing the same game's unique unfolding facts relevant to the proposition in question, such as the personnel and formations on the field, injuries, wind and weather conditions and momentum and the bias based on the percent of cash players who are fans of one team or the other. The sophisticated AI, neural network-based odds setting system is dedicated to estimating what the viewing audience will do with their money at stake within a 5-second window, and one chance to get it right.

The system described herein enables a procedure where live betting odds are set with real time input from the same betting viewing audiences' actual response to the SGO's prop which is effectively utilized as a test proposition to provide a target audience's response to recast the critical odds for actual In-Play and In Running propositions resulting in significantly improved ability of the bookmaker to optimize bookmaking return.

The Participating SGO Generates Accurate Objective Data on the Betting Audience's View of "Even Odds" for a Specific Live Proposition.

WinView is a company offering games of skill based on the real-time offering of In-Play propositions to TV viewers. The contests qualify as games of skill because the winnings of the cash entry fees are distributed to the winners based on the overall performance in selecting a series of 20-25 "Yes" or "No" answers to predictive statements and risking "points" from a limited supply of points (e.g., 5000) provided to every competitor. On each proposition, players can risk from a choice of 250, 500, or 750 "points" (or other number) based on their view of the probabilities of the proposition as it relates to the odds presented by the WinView game producers. The winners are those entrants who "win" the most net points at the end of a quarter long contest (or other time period such as at the end of a half, inning or period, encompassing 20-25 separate In-Play propositions. Again these skill contests entrants are competing against each other, and the SGO makes its money by charging a management fee. The accuracy of the odds does not affect revenues. In fact a major skill factor making these cash contests legal in 41 states is the competitors' knowledge in recognizing where the odds deviate from what they calculate as the true odds. Nevertheless, the expert live game producers are incentivized and graded by how close each proposition comes to achieving a 50/50% distribution between "Yes" and "No" selections by the participants.

For U.S. sports in the U.S. market these SGO propositions are generally presented during breaks in the action and are left open until the second that play is about to resume with a lock out determined when contestants physically present at the game or receiving the earliest arriving TV signal would begin to gain a competitive advantage. For example, the proposition: "The 56 yd field goal attempt will be made," offered within 25 seconds after the commercial break would be locked out as the ball is snapped based on the observation of an employee physically present at the game or another system adjusting for the difference in the arrival of a TV signal and the Web-delivered game data. This would provide the participants in both the SGO and SBO offerings approximately 45 seconds or 25 seconds at worst to make and enter their selection.

From the time that proposition is offered, such as at a commercial break until the lockout, the SGO receives continuous real-time data on how each contestant is reacting to the odds set by live game producers through their "Yes" or "No" selections. In a matter of 1-2 seconds, the percentage of the SGO participants divided between "Yes" and "No" is obtained to an accuracy of +/−1-2%. If the In-Play odds presented by the SBO were not required to be set and displayed concurrent with the time of presentation, or the presentation of the same proposition with the SBO betting odds were delayed a non-essential 2 seconds, then the utilization of the empirical reaction of the same target market generated by a skill game two-screen operator such as WinView received in real time by the SBO to present to the punter continually changing odds driven by the selections of the competitors the continually changing odds would be an experience very similar to that of pari mutuel horse racing wagering. This format is not a legal game of skill, not the method by which sports betting odds are set, and is illegal under the laws governing both the SGO and the SBO.

Methods and Systems of an SBO, Utilizing an SGO's Real-Time Response of the Betting Universe, to Increase Frequency and Accuracy in Presenting Live In-Play Propositions

EXAMPLE

1. Skill Game operator's 1st Quarter contest: Colts at Patriots. Colts intercept on Patriots' 19 yd line. TV goes to commercial break. SGO operator such as WinView's producers push new proposition 10 seconds later.
"The Colts will score a touchdown on this possession."
Odds: "Yes" 2.5"No" 1.7
2. Within 0.5 to 2 seconds the SGO (WinView) receives 5000 responses with 30% "Yes" and 70% "No" (accurate +/−2%) and transmits this information via continuous feed to SBO.
3. SBO receives the WinView proposition as published, feeds it into their AI real time system and pushes the same proposition with the same wording to its sports betting audience within 0.1 seconds with odds left blank. Within 1-2 seconds after receiving the cash skill game players' response to the SGO (WinView's) odds from a projectable sample, the SBO's computer systems generate and display their own odds of 2.8 "Yes" and 1.5 "No" calculated to achieve 50/50%.
4. SBO's customers (for example) actually bet 47% "Yes" and 53% "No" on those adjusted odds.
5. Results of this entire transaction plus specific background including teams, date, weather, universe of bettors, and any other relevant information to this specific proposition are entered into both SGO and SBO's databases of their AI computer systems continually and appropriately adjust and store in memory the data to further improve the accuracy of the system expanding the real world data bases. The system will continually improve the accuracy of the system for this proposition not only for the specific teams and game situation but for the entire system.

The systems and methods utilizing the real time information generated by an SGO such as WinView can also be utilized by a sportsbook presenting In-Play and In Running fixed odds proposition betting to significantly balance risk including those described herein.

The methods and systems of notifying and presenting similar or identical individual live betting propositions to the participants utilizing a web connected application offered in live skill games to users are covered in U.S. Provisional Application No. 62/737,653 filed Sep. 27, 2018, and incorporated herein by reference in its entirety. The capabilities described herein are able to be offered on a single web connected application provided by either the SGO, the SBO, or jointly by both the SGO and the SBO, or by the SBO and a third party with appropriate capability.

In one implementation of this application, the SBO would couple the real-time feed providing the percentage of participant's predictions based on their selections of "Yes" or "No" to a known set of fixed odds from the SGO, which would be incorporated into the software systems utilized to generate the fixed odds the SBO is preparing to offer. This real time data would be incorporated into the real time AI systems using neural network technology and utilized as a factor in setting their odds for the same proposition, presented within seconds of the presentation of the SGO's presentation of the same proposition to the same cohort of bettors watching a sports telecast. Depending on the universe of the SGO users, this might range between 1 and 10 seconds with time lag decreasing in proportion to the participant universe.

In another implementation, the SBO would wait until the level of response from the SGO's player universe reached a statistically significant level of response. It would then calculate using either the SBO's algorithm, the SGO's, or a third-party supplier's, the computation of the true 50-50% odds implied by the actual reaction to the odds presented by their live producers. The SGO would then present the proposition with these odds to sports bettors. In this example, the presentation of the SBO's proposition and odds would lag the SGO's presentation of the proposition by the small amount of time it takes to have a sufficient number of responses to be statistically accurate. Artificial intelligence is able to take into account bettor's reactions to SBO and/or SGO propositions and corresponding odds to develop additional propositions and odds and/or update current propositions and/or odds. For example, if Proposition X receives very little action (e.g., very few selections/bets), then similar propositions may not be offered. In some embodiments, the propositions are grouped or classified (e.g., a group related to passing, a group related to running backs, a group related to fun bets, a group related to color/clothing, and so on). For example, a proposition is offered regarding the color of Tom Brady's socks which is in the color/clothing group, and a small percentage of bettors actually bet on that proposition, then other propositions in the color/clothing group are avoided or are only rarely offered or are offered with much higher odds. In some embodiments, taking into account bettors' reactions includes utilizing video/image analysis to determine facial reactions to the propositions. For example, when a proposition appears, a video capture of users' faces are taken and analyzed, and if it is determined that many users' expressions (e.g., above a threshold) are a frown or a look of disgust (as determined by facial recognition/expression recognition), then that proposition and/or similar propositions are not provided. In some embodiments, the facial expressions and the betting history/results are analyzed in combination by the artificial intelligence. For example, even if many users have a confused expression, if they are still placing wagers, then the artificial intelligence may still determine to provide an additional similar proposition. Any other analysis is able to be performed to determine bettors' reactions to update and/or provide future propositions and/or odds.

In another implementation, a statistically significant panel of selected paid or unpaid viewers could enter their inputs which would be representative of the larger audience watching the game. This "panel" could also be comprised of expert bookmakers or sports bettors whose collective input would be used.

In another implementation the SBO could display with the proposition changing odds driven by either the SGO's live feed or their own feed which incorporates the SGO feed, in a manner similar to the way pari mutuel odds are displayed for horse and dog race wagering as the data changes, the pari mutuel odds change.

A variation of this approach would be used for In Running betting where the proposition's wording is unchanged, but the odds are adjusted periodically by unfolding events and the decrementing game clock. In this incidence the SGO could reoffer the same proposition with new odds to its contest participants. For example, after a score in a soccer game, the same proposition with new odds set by the SGO's producers would be utilized in one or more of the ways addressed above to reset the SBO's odds for the same proposition.

In doing this, the SBO might suspend the acceptance of bets after the score at their server (or any significant odds changing event) while they receive the relevant input from the SGO, reset their odds and inform their bettors whether their bets made before or during the suspension were accepted or rejected by the game server, with software and other systems determining whether advantage has been gained by individuals or cohorts of punters.

As shown in the example, this process will involve computer learning, AI and neural networks, and the systems will have the 20/20 hindsight of seeing the results of the odds reset by the SBO in reliance on the SGO data for different sports and different kinds of propositions. This data is then utilized to continually train and adjust the algorithms using machine learning and neural network technology applying the SGO's feedback mechanism to continually improve accuracy.

The process described herein also addresses separate claims on the collection of the empirical data generated by the SGO on the relationship of the collective reaction to the estimated odds, to the betting response to the recalculated odds utilized and presented by the SBO. The actual betting results from the SBO's proposition are then compared to the response to the odds, then utilized by the SBO and/or the SGO to adjust and perfect the algorithms, both for the specific game in progress and for optimizing the system over time.

An implementation includes an SBO providing a proposition for wagering without odds (e.g., a preview proposition), and also providing the same proposition to the SGO, wherein the SGO receives input in real-time, and based on the input received, provides that information to the SBO who then generates the appropriate odds to be displayed with the previewed proposition. Betting for the SBO proposition may or may not be available until the odds are posted. In a variation the odds provided for the SBO's proposition can be changed before being locked out, or after lockout and then replaced, as is currently being done with live In Running betting where the proposition wording is unchanged, but new odds are presented while the previous odds are locked.

A significant benefit is the ability to offer not only more interesting and attractive propositions tracking the game play, but the ability to offer more custom betting opportunities for each televised game; for example, the very popular propositions with some sense of humor—"If Gronk scores in this quarter his celebratory spin of the football will last more than 8 seconds"—. This system would eliminate the very substantial risk this kind of proposition presents which would have no data to support it.

To summarize, the desired end result of the process is to enable the sports betting operator to make available more frequent, more varied, and more unique propositions to their customers which will increase engagement and participation. At the same time, the process provides the SBO with a real-time system which not only eliminates the risk in offering "one of a kind" in the moment propositions for which insufficient data exists, but also instantly and accurately predicts the actual response to the target betting audience for that proposition. Live bookmakers may have different goals and strategies to maximize their return on a proposition, which may not necessarily be achieving a risk free 50/50 balance of the book on a prop. They might offer "sucker" odds to take advantage of the fact that the system indicates which team is drawing the strongest backing. The AI driven software system can accurately calculate the risk/reward ratio to the bookmaking strategy for each proposition. Conversely, data generated by the SBO would be sent to the SGO production computer systems to enable more controlled, faster predictable odds setting procedures to provide fun and entertainment as well as odds that enable more skilled competitors to prevail.

FIG. 1 illustrates a flowchart of a method of utilizing SGO data to optimize SBO propositions according to some embodiments. In the step 100, an SGO utilizing live producers provides real-time skill game propositions as described herein (e.g., will the next pass be completed—yes/no). The SGO (or SGO's system) receives responses from participants such as out of the first 10,000 participants, 6,000 participants select "yes," and 4,000 participants select "no." The collected data is then able to be processed and/or communicated to the SBO. In the step 102, the SBO utilizes the collected data (and/or additional data) to generate and present odds/propositions more reflective of true odds based upon the opinions of a sample universe of potential punters/bettors viewing the same contest. In some embodiments, the process is implemented automatically using AI to provide a proposition or the odds for skill game participants, collect the results from those participants and use that data to automatically generate appropriate odds for the same or similar propositions for the live sports betting participants. In some embodiments, the process occurs in a very short amount of time; sometimes under 1 second, much faster than a human could collect the data, analyze the data and provide an output based on the data. In some embodiments, additional or fewer steps are implemented.

Figure 2:
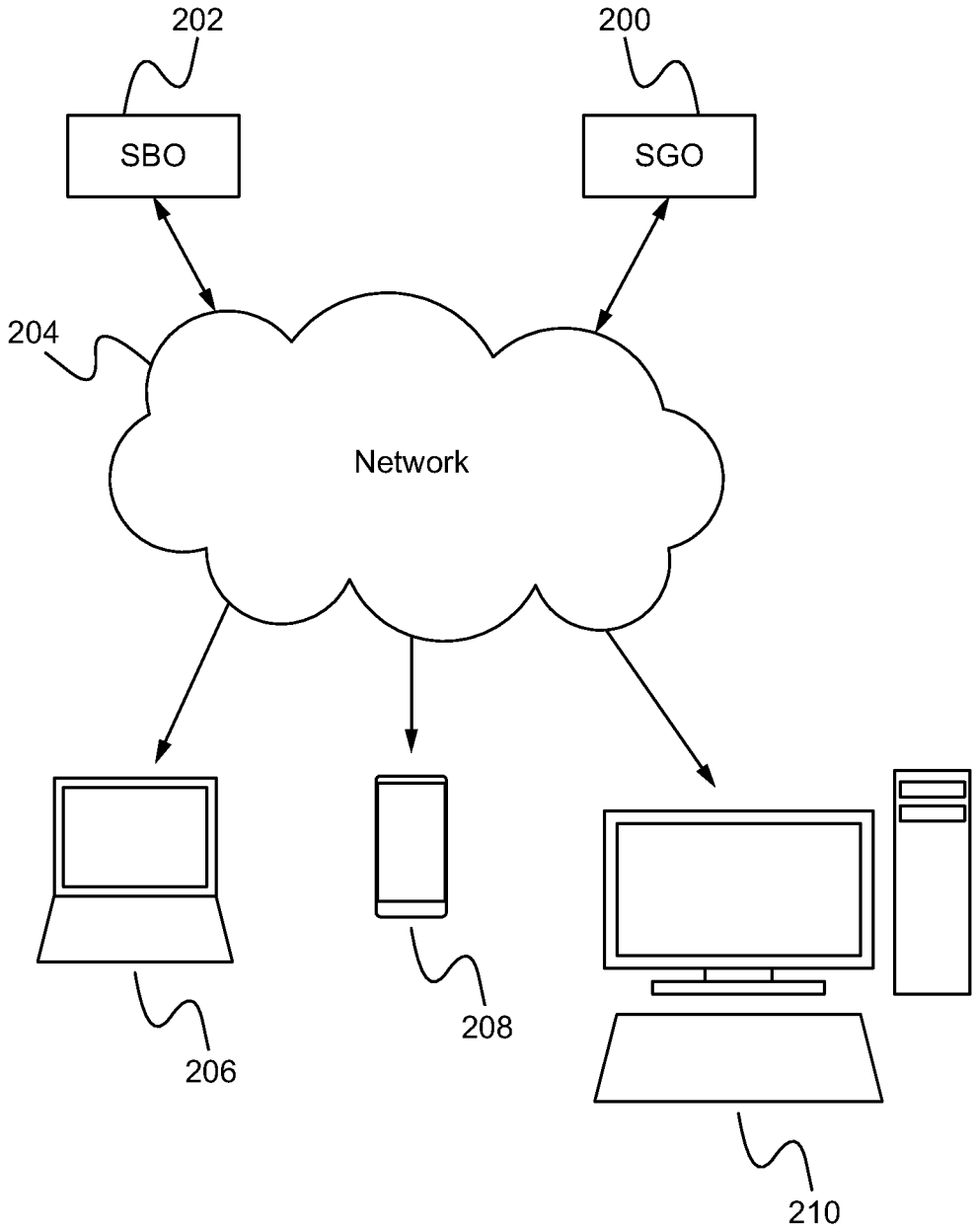
FIG. 2 illustrates a diagram of a network of devices involved in the method of utilizing SGO data to optimize SBO propositions according to some embodiments.

FIG. 2 illustrates a diagram of a network of devices involved in the method of utilizing SGO data to optimize SBO propositions according to some embodiments. An SGO device 200 is utilized to provide SGO propositions and/or receive user input based on the propositions. For example, the SGO device 200 is a game server or a group of servers configured to generate/host/send/control real-time skill game propositions and receive any communications (e.g., selections/responses) from skill game users/participants.

An SBO device 202 is utilized to provide SBO propositions and/or receive user input based on the propositions. For example, the SBO device 202 is a server or a group of servers configured to generate/host/send/control real-time sports betting propositions and receive any communications (e.g., selections/responses) from sports betting users/participants.

The SGO device 200 and the SBO device 202 are able to communicate with each other as well, directly (e.g., peer-to-peer) or over a network 204 (e.g., the Internet, a LAN, a cellular network). The SGO device 200 is able to send information (e.g., input results from real-time propositions) to the SBO device 202 which then utilizes the information to generate odds for sports betting propositions. The SBO device 202 is able to then communicate the odds to casinos and/or gaming applications to receive wagers on the propositions.

In some embodiments, the SGO device 200 and the SBO device 202 are one device.

Devices such as a laptop 206, a mobile phone 208, a computer 210, a dedicated betting terminal 220, or any other web connected capable devices are able to be used to participate in the skill game competitions and/or the sports betting by sending information (e.g., responses) to and receiving information (e.g., propositions) from the SGO device 200 and/or the SBO device 202.

The devices of the network are able to communicate through the network 204 or directly with each other. A user is able to use the computer 210, a television, the mobile phone 208 and/or any other device to perform tasks such as to join competitions, view betting odds, provide selections for propositions, watch events (e.g., sports) and/or any other tasks.

In some embodiments, fewer or additional devices are able to be included in the network of devices. The network of devices is able to include any number of devices. For example, the network of devices is able to include a smart television with an internet connection.

Figure 3:
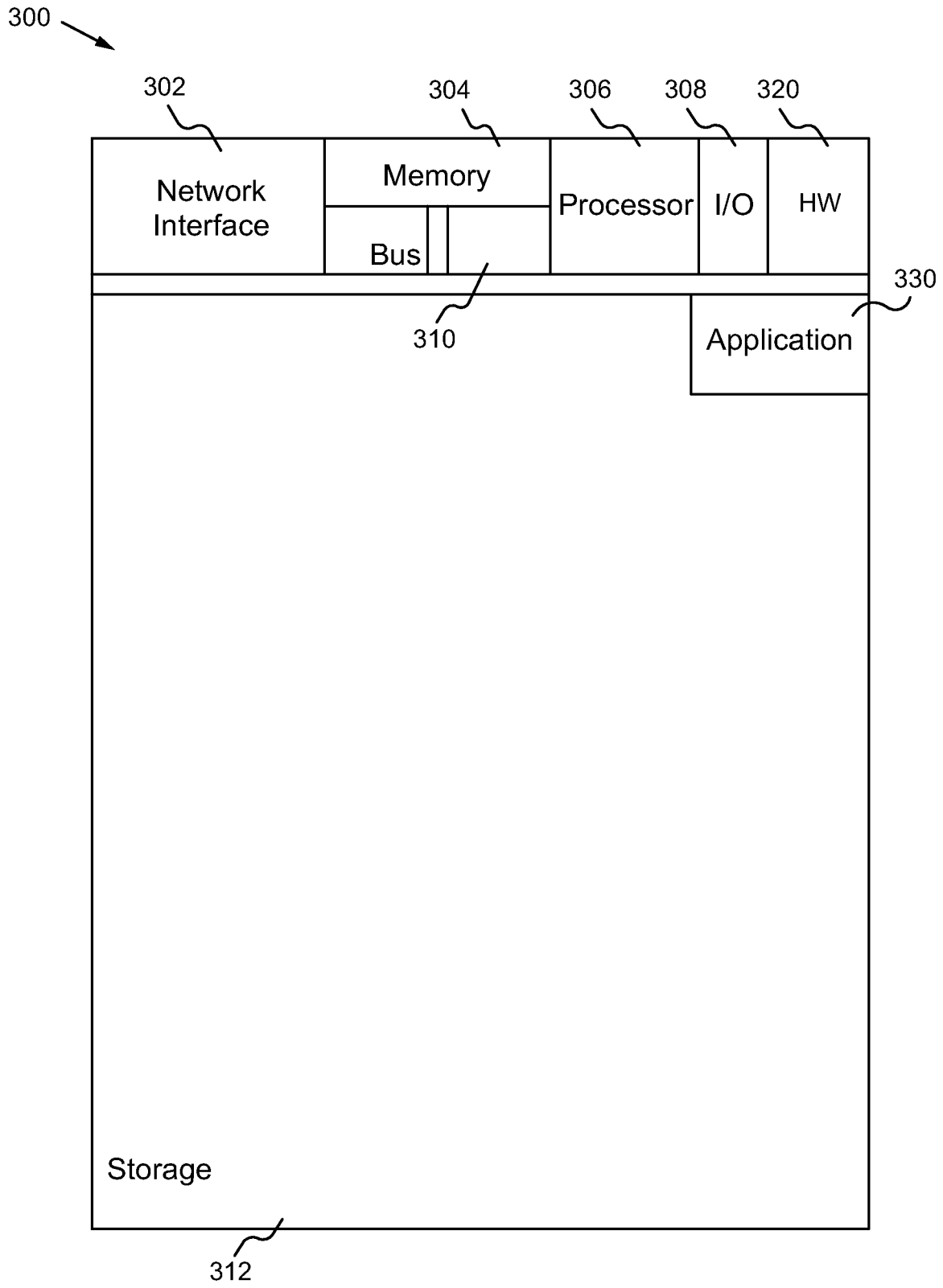
FIG. 3 illustrates a block diagram of an exemplary computing device configured for implementing the method of utilizing SGO data to optimize SBO propositions according to some embodiments.

FIG. 3 illustrates a block diagram of an exemplary computing device configured for implementing the method of utilizing SGO data to optimize SBO propositions according to some embodiments. The computing device 300 is able to be used to acquire, store, compute, process, communicate and/or display information. In general, a hardware structure suitable for implementing the computing device 300 includes a network interface 302, a memory 304, a processor 306, I/O device(s) 308, a bus 310 and a storage device 312. The choice of processor is not critical as long as a suitable processor with sufficient speed is chosen. The memory 304 is able to be any conventional computer memory known in the art. The storage device 312 is able to include a hard drive, CDROM, CDRW, DVD, DVDRW, High Definition disc/drive, ultra-HD drive, flash memory card or any other storage device. The computing device 300 is able to include one or more network interfaces 302. An example of a network interface includes a network card connected to an Ethernet or other type of LAN. The I/O device(s) 308 are able to include one or more of the following: keyboard, mouse, monitor, screen, printer, modem, touchscreen, button interface and other devices. SGO/SBO proposition application(s) 330 used to perform the SGO/SBO proposition method are likely to be stored in the storage device 312 and memory 304 and processed as applications are typically processed. More or fewer components shown in FIG. 3 are able to be included in the computing device 300. In some embodiments, SGO/SBO proposition hardware 320 is included. Although the computing device 300 in FIG. 3 includes applications 330 and hardware 320 for the SGO/SBO proposition method, the SGO/SBO proposition method is able to be implemented on a computing device in hardware, firmware, software or any combination thereof. For example, in some embodiments, the SGO/SBO proposition applications 330 are programmed in a memory and executed using a processor. In another example, in some embodiments, the SGO/SBO proposition method is programmed hardware logic including gates specifically designed to implement the SGO/SBO proposition method.

In some embodiments, the SGO/SBO proposition application(s) 330 include several applications and/or modules. In some embodiments, modules include one or more submodules as well. In some embodiments, fewer or additional modules are able to be included.

Examples of suitable computing devices include a personal computer, a laptop computer, a computer workstation, a dedicated betting terminal, a server, a mainframe computer, a handheld computer, a personal digital assistant, a cellular/mobile telephone, a smart appliance, a gaming console, a digital camera, a digital camcorder, a camera phone, a smart phone, a portable music player, a tablet computer, a mobile device, a video player, a video disc writer/player (e.g., DVD writer/player, high definition disc writer/player, ultra high-definition disc writer/player), a television, a home entertainment system, an augmented reality device, a virtual reality device, smart jewelry (e.g., smart watch) or any other suitable computing device.

Figure 4:
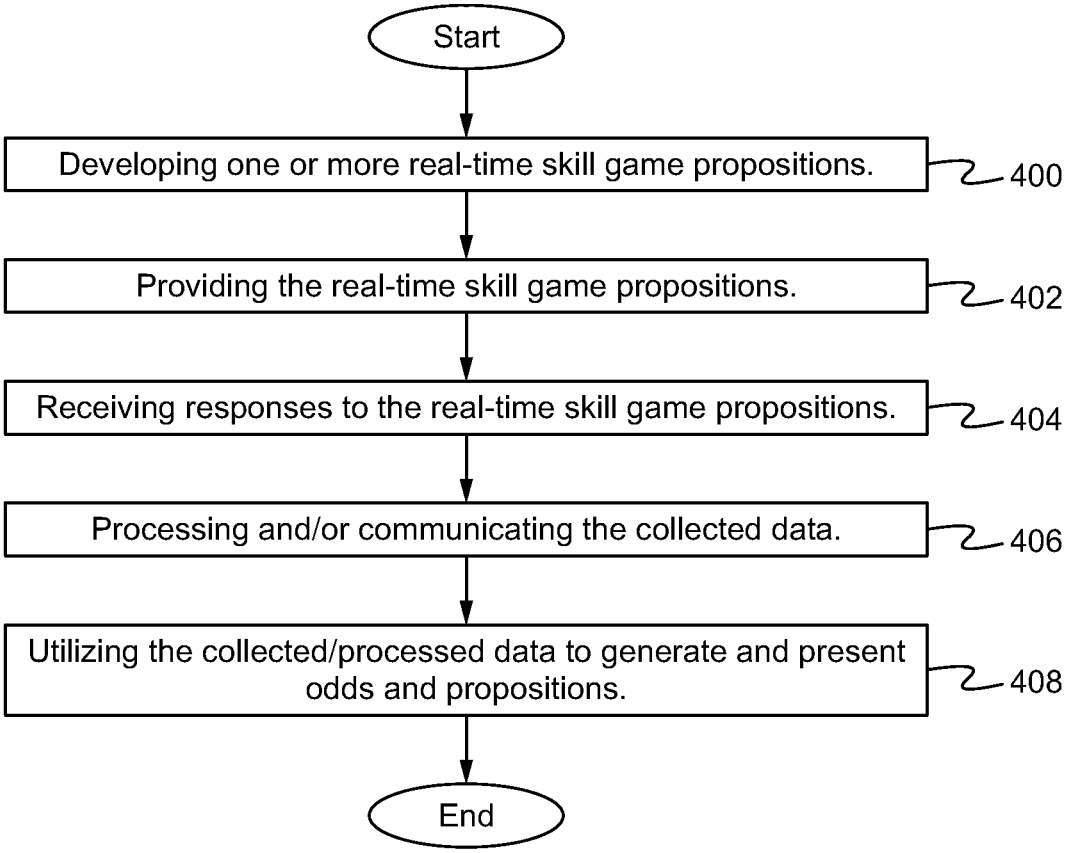
FIG. 4 illustrates a flowchart of a method of utilizing SGO data and artificial intelligence to optimize SBO propositions according to some embodiments.

FIG. 4 illustrates a flowchart of a method of utilizing SGO data and artificial intelligence to optimize SBO propositions according to some embodiments. In the step 400, one or more real-time skill game propositions are developed. For example, a set of 20 real-time skill game propositions are generated and organized so that they are easily displayed at a specific time/situation. The real-time skill game propositions are able to be generated manually by a producer or automatically using artificial intelligence. For example, using artificial intelligence, a device acquires event-related information such as the weather, current player statistics, current event information (e.g., in football, the down and distance and time remaining), historical information, and/or any other information. The information is able to be very specific or organized such that cross-references are able to be generated or determined. For example, the data is able to be stored in a manner such that when a quarterback is playing in a game that is going to be very cold, past historical information, including specifically cold-weather games, is able to be located. The device is able to acquire the information from one or multiple sources. The artificial intelligence utilizes structures and neural networks to learn based on additional information (e.g., received daily or weekly). For example, the device using artificial intelligence generates a structure/object using object oriented programming for each player and/or event and collects data for the player/event to develop the structure/object. As additional information is acquired regarding a player and/or event, the structure/object is able to be modified and/or grow. The developed structure/object is able to be utilized in determining a real-time skill game proposition. For example, if the quarterback has thrown 8 consecutive incomplete passes, a real-time skill game proposition could inquire whether the next pass will be completed, or since viewers may be aware of the quarterback's struggles, the real-time skill game proposition would avoid asking a pass question since most users would likely assume that he will not complete the next pass, so a question about running with the football is able to be asked or a more general question about passing could be asked, such as "will the quarterback complete at least one pass on the next drive?"

In the step 402, an SGO provides real-time skill game propositions as described herein (e.g., will the next pass be completed—yes/no). The real-time skill game propositions are presented in any manner such as displayed directly on the user's television or displayed on a mobile device (e.g., cellular/smart phone, tablet, smart watch) or other device such as a laptop computer or personal computer. In some embodiments, a countdown is provided with each real-time skill game proposition. The real-time skill game propositions are able to be presented for a limited amount of time (e.g., 3 or fewer seconds, 5 seconds, 30 seconds or more). In some embodiments, factors may affect how long the real-time skill game propositions are presented, such as delays in receiving a televised/broadcast/Internet signal.

In the step 404, the SGO (or SGO's system) receives responses from participants, such as out of the first 10,000 participants, 6,000 participants select "yes," and 4,000 participants select "no." The participants are able to provide their selections through any user interface provided. The user interface is able to be a complex web page providing vast amounts of statistical data in addition to the propositions and buttons to select a response. The user interface is able to be a simple app that is displayed on a mobile phone or smart watch which shows each real-time skill game proposition in conjunction with a "yes" button and a "no" button. Any GUI features are able to be utilized. Any programming language is able to be utilized. In some embodiments, instead of or in addition to yes/no selections, other types of selections are possible such as true/false, multiple choice from (3, 4 or more choices) and/or others.

In the step 406, the collected data is then able to be processed and/or communicated to the SBO. The data is processed to detect for patterns and/or make calculations as well as for any other purposes (e.g., to process the real-time skill game propositions). For example, the percentage of "yes" versus "no" selections is determined which is then used to affect odds of other propositions. As described herein, a formula is able to be used which takes a first set of odds (e.g., initially generated manually by an employee at a sportsbook or utilizing artificial intelligence) and then adjust the first set of odds based on the results of the real-time skill game propositions. In some embodiments, pattern recognition is implemented to determine if any users are cheating or performing the same selection repeatedly. For example, if the selection history of User A shows all "no" selections, then those selections should be ignored when performing the calculations as there does not appear to be a valid and fair attempt at making a selection.

In the step 408, the SBO utilizes the collected/processed data (and/or additional data) to generate and present odds/propositions more reflective of true odds based upon the opinions of a sample universe of potential punters/bettors viewing the same contest. The odds are for the same or similar propositions for the live sports betting participants. For example, if an SGO generates a question: "Will Team X score on its next possession?" an SBO will provide the same or a comparable question/proposition. The odds for the SBO proposition will be affected based on the input received for the SGO question. Furthering the example, the initial odds for the proposition are "yes" 2.5 and "no" 1.7, but based on responses to the SGO question which are 30% "yes" and 70% "no," the odds for the proposition are changed to "yes" 2.8 and "no" 1.5, so that the betting on the proposition is closer to 50% for either option of the bet. In some embodiments, the process occurs in a very short amount of time; sometimes under 1 second, much faster than a human could collect the data, analyze the data and provide an output based on the data. In some embodiments, additional or fewer steps are implemented.

To use the method of utilizing SGO data to optimize SBO propositions, operators receive data based on skill game propositions and then base sports bet propositions (including odds) on that data. Users are able to participate in the skill game competitions and the sports bet propositions.

In operation, the method of utilizing SGO data to optimize SBO propositions enables that which is impossible without it. In particular, to determine proper, accurate odds for unique situational In-Play propositions, significant real-time data must be collected and analyzed in real time, which is not possible without a computing device, and is significantly improved by utilizing skill game information, where the skill game information is collected from thousands or millions of users across the globe.

Although skill game propositions and In-Play propositions have been described herein, any type of propositions are able to be implemented.

The method, devices and systems described herein are able to implement additional features such as age verification, user location verification (e.g., determining a physical, geographical location of a user/device based on GPS information or other information, and using the geographical location to determine if the laws in that location permit the activity/gaming/service), user home address verification, receiving credit card information, receiving wagering options, providing prizes and/or other winnings, cheating detection, and/or any other features described herein or incorporated by reference herein.

The event for which the propositions are made is able to be: a televised-event, live event, broadcast event, Internet-broadcast event, a single competition, multiple genres of athletic or other types of contests, multiple competitions taking place at the same time, in a single day, week or season, a partial contest, an arbitrary or specific segment of an athletic or other type of contest, sport-based contests, non-sport-based contests, a weekly event, a week-long event, a competitive game show, a television show, a movie, a video, an electronic sports (e-sports) event, card, dice, trivia, math, word, and/or puzzle games, a television-based event, a scheduled competition, a scheduled series of competitions, a sporting event, a real-time skill and chance-based sports prediction games, an event based on a video game, a computer game or electronic game, an entertainment show, a taped event, a game show, a reality show, a news show, a commercial contained in a broadcast, and/or any other events described herein or incorporated by reference herein.

The event is able to be attended by a user and/or an employee with a device to trigger lockout signals or otherwise control when selections are able to be made and/or blocked.

In some embodiments, the devices and/or servers are optimized to implement the odds setting implementations. For example, data that is accessed more frequently is stored on faster access storage (e.g., RAM as opposed to slower storage devices). Furthering the example, the data relevant for the current week is stored on faster access storage, and data from past weeks is stored on slower storage devices. In another example, when a user selects a competition/contest, information related to that competition/contest is moved to local storage for faster access.

For the real-time skill-game propositions, latency issues could possibly give some users an unfair advantage. The latency issues are solved through a system and method to effectively equalize systemic propagation delay variances to a required level dictated by the demands and rules of a particular game, so that a material competitive advantage is not obtained, and the user experience is optimized for all players.

The solution includes first determining how each viewer is receiving their television signal (e.g. via an over the air broadcast in a metropolitan area, via a particular cable system or a particular satellite system, via streaming). All subscribers to a particular service provider or who are receiving an over the air broadcast in a specific metropolitan area will receive the signal at their location at the same time. It is also able to be determined if there is further processing of the signal within the homes, office, bar and others, which could further increase the total length of the propagation delay. Examples would be the use of a DVR, such as TiVo™. A variety of methodologies are able to be utilized to determine the time difference between the reception of the television picture being utilized by the central game production facility where "lock out" signals are generated and each separate group of viewers around the country or around the world.

One approach is to survey the delays encountered through the various delivery systems such as cable, over the air or satellite in various geographic areas and adjust the synchronization of the game control information for all players to optimize the game play experience while defeating cheating enabled by receiving late lock outs to questions.

In another approach, the total viewing population for a telecast is divided into segments or blocks of viewers referred to as "cohorts." For example, the 2 million inhabitants of the San Francisco Bay Area would be divided into approximately 1 over the air broadcast, 3 satellite independent providers and several cable "head ends" or central broadcast points serving a "cohort." This information would be gathered at a central game server, and all players registered to play in a particular contest would be assigned to a specific cohort of viewers.

The following are some other methodologies for determining the delays experienced by various cohorts who are able to be used in combination or separately.

In one methodology, upon joining the service and prior to initial game play, subscribers and competitors are required to identify the method by which they receive their television signal and identify the cable or satellite service provider and answer questions relative to whether or not they subscribe to an analog or digital high definition service or utilize a DVR. This information is able to be verified by sending questions to their cellular phones concerning commercials, station breaks and the precise time they are viewed or utilizing other information only seen by members of that cohort.

In another methodology, a routine is established upon first entry into a game where the individual viewer is asked to mark the precise time a predetermined audio or visual event in the television program occurs, such as the initial kickoff, which would establish the deviation of their receipt of their television picture from the television signal utilized by the game producers. While some viewers might attempt to cheat by delaying their input, the earliest entries from the cohorts in this group would be averaged to establish the accurate delta between the receipt of the telecast/stream by the production crew and those in each discrete sub-group of viewers.

In another methodology, the GPS function in the cellular phone is used to determine the physical location of a viewer which is matched to a database of cable lead ends or over the air broadcast stations available to a consumer in that precise location.

In another methodology, employees of the game producer who are members of the subgroups which constitute the competitors/viewers, e.g. a subscriber to Comcast Cable in San Francisco, are utilized by the game service provider. These individuals would provide the current propagation delay information sent to the game server utilizing their identification of a recognizable event they observe on their television set, such as the initial snap of the ball.

In another methodology, audio or video artifacts or information done in cooperation with the television signal provider are inserted which must be immediately responded to by the competitor to verify the source of their television signal or monitored at cooperative viewers' television sets.

In another methodology, the various delays through an automated system linked to the game server, which continuously samples the audio or video track of the underlying satellite, cable or over the air broadcast television signals are established around the country to provide the information of the precise arrival of the underlying television picture.

Utilizing software resident in a game control server, game control data for each set of viewers/competitors of the game in progress who are receiving their television picture or streaming content through the same source are batched together by the game control server, and the appropriate delay is either time stamped on the game "lock out" signals, or is imposed on the entire data stream so that competitors receiving their content slightly behind or ahead of others gain no material competitive advantage. Another method is for the game control server to send all the game control data to all of the viewers/competitors of the game at the same time, and the client software is able to delay the presentation of the game data based on the viewers' cohort.

Utilizing these methodologies to measure the delays in each cohort, each cohort of viewers would have artificial time delays on the game control information imposed by the game control server, which would substantially equalize the receipt of "lock out" data relative to the event triggering the "lock out," based on the underlying television programming, for example, the snap of the football. Players receiving the television signals or streaming content in advance of the one with the slowest receipt of the television signal or streaming content would receive "lock out" signals slightly delayed or time stamped with a slightly later time as described in U.S. Pat. No. 4,592,546. By providing a correspondingly delayed lock out to a viewer receiving their signal later, a potential advantage is mitigated.

Alternatively, this time equalization from cohort to cohort could, for example, involve artificially delaying the transmission of the game control data stream sent to all competitors' cell phones or other mobile devices by the appropriate amount of seconds, to sufficiently minimize the advantage a player with a few more seconds of television-based (or streaming-based) information would have. For example, by time stamping the "lock out" signal at an earlier event, such as when the team breaks from the huddle, the chance of some cohorts seeing the actual beginning of the play is eliminated and the discrepancy in propagation delay provides little or no advantage.

In some embodiments, the SGO data (e.g., propositions and odds) is provided to an SBO app. In some embodiments, the SGO implements an app which utilizes the SGO data to provide propositions (e.g., real-time skill game and In-Play) and odds through the app. In some embodiments, hot links are provided to partnering apps. In some embodiments, the SGO populates a database with propositions, proposition selections/results, team information, player information, historical data, and/or any other information, and makes the database/information accessible in real-time to licensed bookmakers to generate odds and/or propositions.

Figure 5:
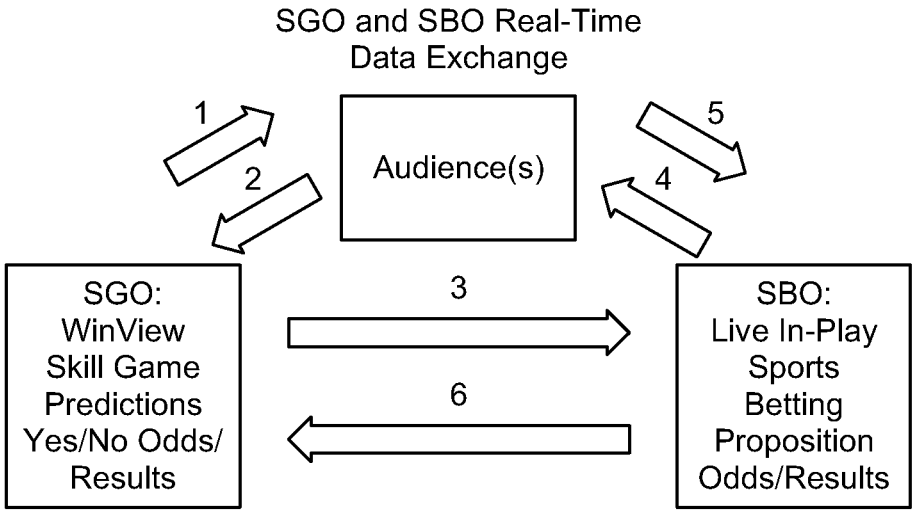
FIG. 5 illustrates a diagram of reducing risk in setting odds according to some embodiments.

FIG. 5 illustrates a diagram of reducing risk in setting odds according to some embodiments. The SGO provides propositions (e.g., yes/no predictions) and/or odds to an audience (e.g., competitors for a real-time game of skill). The audience provides feedback to the SGO such as responses to the propositions based on the specific propositions and/or odds. The SGO provides the feedback/results to an SBO. The SBO provides propositions (e.g., sports betting propositions) and/or odds to the audience. The audience for the SBO propositions is able to be the same audience for the SGO propositions, a different audience, or any combination thereof. The SBO receives the results from the propositions. The results from the SBO propositions are able to be sent to the SGO to update an algorithm for providing the SGO propositions and/or odds. The data provided and received by the SGO, the SBO and the audience is able to be used in any manner by AI, one or more learning algorithms, and/or any other analytical system to optimize the accuracy and efficiency of the betting operation (e.g., such that 50% of the audience selects one side of a proposition, and the other 50% of the audience selects the other side of the proposition).

As shown in the example, this process will involve computer learning, AI and neural networks, and the systems will have the 20/20 hindsight of seeing the results of the odds reset by the SBO in reliance on the SGO data for different sports and different kinds of propositions. This data is then utilized to continually train and adjust the algorithms using machine learning and neural network technology applying the SGO's feedback mechanism to continually improve accuracy.

The process described herein also addresses separate claims on the collection of the empirical data generated by the SGO on the relationship of the collective reaction to the estimated odds, to the betting response to the recalculated odds utilized and presented by the SBO. The actual betting results from the SBO's proposition are then compared to the response to the odds, then utilized by the SBO and/or the SGO to adjust and perfect the algorithms, both for the specific game in progress and for optimizing the system over time.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A method programmed in a non-transitory memory of a device for interaction with events comprising:

providing one or more real-time skill game propositions;

receiving selections to the one or more real-time skill game propositions relating to the events;

providing odds for one or more In-Play live betting propositions based on a response to the selections to the one or more real-time skill game propositions; and equalizing the one or more real-time skill game propositions wherein variances in receipt of the events by participants are utilized for equalizing locking out the participants, wherein equalizing the one or more real-time skill game propositions includes input from a person in physical attendance at a venue corresponding to the events.

2. The method of claim 1 further comprising developing the one or more real-time skill game propositions.

3. The method of claim 2 wherein developing the odds for one or more real-time live betting propositions comprises utilizing artificial intelligence or analytics to automatically acquire real time statistical information from the concurrent real time skill contest.

4. The method of claim 1 wherein providing the one or more real-time skill game propositions comprises displaying the one or more real-time skill game propositions simultaneously with an underlying broadcast of an event.

5. The method of claim 1 wherein receiving the selections to the one or more real-time skill game propositions includes receiving input from end user devices.

6. The method of claim 1 further comprising real-time processing the selections to the one or more real-time skill game propositions.

7. The method of claim 6 wherein processing includes determining percentages of the selections.

8. The method of claim 7 wherein providing the odds for one or more In-Play live betting propositions includes adjusting previously determined odds based on the percentages of the concurrent skill game selections.

9. The method of claim 1 further comprising providing the one or more In-Play betting propositions.

10. The method of claim 1 wherein an In-Play betting proposition is presented initially without the odds, and then after the information related to real-time skill game propositions is received and processed, the odds are presented.

11. The method of claim 1 wherein the one or more real-time skill game propositions are related to a live esports tournament.

12. The method of claim 1 wherein the one or more real-time skill game propositions are related to one or more non-athletic, televised events.

13. The method of claim 1 wherein the one or more real-time skill game propositions are related to one or more occurrences.

14. The method of claim 1 wherein the odds for the one or more In-Play live betting propositions are further based on an expert panel or a subset of viewers of the live event.

15. A system comprising:

a skill game server device configured to provide real-time skill game propositions to a first cohort of participants; and a real-time server device configured to receive responses related to the real-time skill game propositions from the skill game server device and provide In-Play betting propositions to a second cohort of participants, wherein odds for the In-Play proposition is determined based on the information received by the real-time server device related to the real-time response to the same skill game proposition, wherein the skill game server device and the real-time server device are separate real-time computer systems, wherein the real-time server device is further configured to equalize the one or more real-time skill game propositions wherein variances in receipt of televised events by participants are utilized for equalizing locking out the participants, wherein equalizing the one or more real-time skill game propositions includes input from a person in physical attendance at a venue corresponding to the televised events.

16. The system of claim 15 wherein the skill game server device is further configured for developing the one or more real-time skill game propositions.

17. The system of claim 16 wherein developing the one or more real-time skill game propositions comprises utilizing analytical software including artificial intelligence to automatically acquire statistical information utilized by human game producers to provide propositions and set accompanying odds.

18. The system of claim 17 where a database and real-time data from the competitors' responses to the propositions in the skill games are processed by dedicated computers running programs utilizing, artificial intelligence and machine learning to generate an archival database continually utilized by the live sports betting system to improve performance in odds setting accuracy.

19. The system of claim 15 wherein the real-time server device is further configured for providing the one or more real-time skill game propositions which comprises displaying the one or more real-time skill game propositions simultaneously with an underlying broadcast of an event.

20. The system of claim 15 wherein receiving the selections to the one or more real-time skill game propositions includes receiving input from end user devices.

21. The system of claim 15 wherein the real-time server device is further configured for simultaneous processing of the selections to the one or more real-time skill game propositions.

22. The system of claim 21 wherein processing includes determining the percentages of the alternative selections to the propositions.

23. The system of claim 22 wherein the real-time server device is further configured for providing the odds for one or more In-Play betting propositions including adjusting previously determined odds based on the percentages of the concurrent selections by the skill contest competitors.

24. The system of claim 15 wherein the real-time server device is further configured for providing the same one or more In-Play betting propositions through receipt of real time data from the skill game operator game server.

25. The system of claim 15 wherein an In-Play betting proposition is presented initially without the odds, and then after the information related to real-time skill game propositions is received, the odds are presented.

26. The system of claim 15 wherein the real-time skill game propositions are related to a live esports tournament.

27. The system of claim 15 wherein the real-time skill game propositions are related to one or more non-athletic, televised events.

28. The system of claim 15 wherein the real-time skill game propositions are related to one or more occurrences.

29. The system of claim 15 wherein data generated by the real-time server is sent to the skill game server to enable more controlled, faster and more predictable odds-setting procedures to provide entertainment in addition to skill game odds.

30. The system of claim 15 wherein the odds for the In-Play proposition are further based on an expert panel or a subset of viewers of the live event.

31. A method programmed in a non-transitory memory of a device for interaction with televised events comprising:

providing one or more real-time skill game propositions;

receiving selections to the one or more real-time skill game propositions relating to the televised events; and providing odds for one or more In-Play live betting propositions based on a response to the selections to the one or more real-time skill game propositions; and equalizing the one or more real-time skill game propositions wherein variances in receipt of the televised events by participants are utilized for equalizing locking out the participants, wherein equalizing the one or more real-time skill game propositions includes input from a person in physical attendance at a venue corresponding to the televised events.

32. The method of claim 31 further comprising developing the one or more real-time skill game propositions.

33. The method of claim 32 wherein developing the odds for one or more real-time live betting propositions comprises utilizing artificial intelligence or analytics to automatically acquire real time statistical information from the concurrent real time skill contest.

34. The method of claim 31 wherein providing the one or more real-time skill game propositions comprises displaying the one or more real-time skill game propositions simultaneously with an underlying broadcast of an event.

35. The method of claim 31 wherein receiving the selections to the one or more real-time skill game propositions includes receiving input from end user devices.

36. The method of claim 31 further comprising real-time processing the selections to the one or more real-time skill game propositions.

37. The method of claim 36 wherein processing includes determining percentages of the selections.

38. The method of claim 37 wherein providing the odds for one or more In-Play live betting propositions includes adjusting previously determined odds based on the percentages of the concurrent skill game selections.

39. The method of claim 31 further comprising providing the one or more In-Play betting propositions.

40. The method of claim 31 wherein an In-Play betting proposition is presented initially without the odds, and then after the information related to real-time skill game propositions is received and processed, the odds are presented.

41. The method of claim 31 wherein the one or more real-time skill game propositions are related to a live esports tournament.

42. The method of claim 31 wherein the one or more real-time skill game propositions are related to one or more non-athletic, televised events.

43. The method of claim 31 wherein the one or more real-time skill game propositions are related to one or more occurrences.

44. A system for interaction with televised events comprising:

a first server configured to:

provide one or more real-time skill game propositions;

receive selections to the one or more real-time skill game propositions relating to the events from a plurality of users spread across a country; and trigger a lockout signal to prevent users of the plurality of users from submitting selections; and a second server configured to:

provide odds for one or more In-Play live betting propositions based on a response to the selections to the one or more real-time skill game propositions, wherein the odds for the one or more In-Play betting propositions are calculated within a second based on thousands of the selections to the one or more real-time skill game propositions; and equalize the one or more real-time skill game propositions wherein variances in receipt of the televised events by participants are utilized for equalizing locking out the participants, wherein equalizing the one or more real-time skill game propositions includes input from a person in physical attendance at a venue corresponding to the televised events.

* * * * *